US012648628B2

(12) United States Patent
Alexa et al.

(10) Patent No.: US 12,648,628 B2
(45) Date of Patent: Jun. 9, 2026

(54) SHADING STRUCTURE

(71) Applicant: Minusplus Generáltervez Kft., Budapest (HU)

(72) Inventors: Zsolt Alexa, Budapest (HU); Géza Csire, Budapest (HU); Ákos Schreck, Budapes (HU); Donát Csegö Rabb, Budapest (HU)

(73) Assignee: Minusplus Generáltervez Kft., Budapest (HU)

( * ) Notice: Subject to any disclaimer, the term of this patent is extended or adjusted under 35 U.S.C. 154(b) by 117 days.

(21) Appl. No.: 18/019,992

(22) PCT Filed: Sep. 3, 2020

(86) PCT No.: PCT/HU2020/050041

§ 371 (c)(1),
(2) Date: Feb. 6, 2023

(87) PCT Pub. No.: WO2022/029458

PCT Pub. Date: Feb. 10, 2022

(65) Prior Publication Data

US 2023/0354972 A1 Nov. 9, 2023

(30) Foreign Application Priority Data

Aug. 7, 2020 (HU) ..... P2000262

(51) Int. Cl.
*A45B 23/00* (2006.01)
*A45B 25/14* (2006.01)
*A45B 25/18* (2006.01)

(52) U.S. Cl.
CPC ..... *A45B 23/00* (2013.01); *A45B 25/14* (2013.01); *A45B 25/18* (2013.01); *A45B 2023/0012* (2013.01); *A45B 2023/0093* (2013.01)

(58) Field of Classification Search
CPC ..... A45B 2023/0012; A45B 2019/026; A45B 2023/0087
See application file for complete search history.

(56) References Cited

U.S. PATENT DOCUMENTS 3,252,469 A * 5/1966 Peake ..... A45B 23/00 52/80.2
4,274,429 A * 6/1981 Kinski ..... A45B 23/00 135/20.1

(Continued)

FOREIGN PATENT DOCUMENTS

BE 1028204 A9 * 11/2021
DE 20210082 U1 2/2003

(Continued)

OTHER PUBLICATIONS

European Patent Office, International Search Report in PCT Application No. PCT/HU2020/050041, Mar. 18, 2021 (5 pgs.) and Written Opinion Of The international Searching Authority (5 pgs.).

*Primary Examiner* — Noah Chandler Hawk
(74) *Attorney, Agent, or Firm* — Wood Herron & Evans LLP

(57) ABSTRACT

The invention is a shading structure (10) comprising a canopy (12), wherein the canopy (12) is affixed to further components of the shading structure (10) at at least two attachment places (18), wherein the two attachment places (18) define an axis of rotation (21), and at least two stiffening sections (14) arranged along a periphery of the canopy (12), wherein the canopy (12) is stretched in an open state of the shading structure (10) by means of the stiffening sections (14). In the open state of the shading structure (10) the stiffening sections (14) are skew with respect to the axis of rotation (21), and in a closed state the stiffening sections (14)

(Continued)

extend in the direction of the axis of rotation (21), and the canopy (12) is rolled up around the axis of rotation (21). (FIG. 15)

5 Claims, 13 Drawing Sheets

(56) References Cited

U.S. PATENT DOCUMENTS

| | | | | |
|---|---|---|---|---|
| 4,347,862 | A * | 9/1982 | Secon | A45B 17/00 135/20.1 |
| 4,360,035 | A * | 11/1982 | Dillman | A45B 23/00 135/20.1 |
| 4,607,653 | A | 8/1986 | Hermanson | |
| 7,513,267 | B2 * | 4/2009 | Gendriesch | A45B 23/00 135/31 |
| 10,694,823 | B2 * | 6/2020 | Aubry | A45B 25/02 |

FOREIGN PATENT DOCUMENTS

| | | | |
|---|---|---|---|
| ES | 1065361 | U | 8/2007 |
| FR | 2428417 | A1 | 1/1980 |

* cited by examiner

SHADING STRUCTURE

This application claims priority, under Section 371, and/or as a continuation under Section 120, to PCT Application No. PCT/HU2020/050041, filed Sep. 3, 2020, which claims priority to Hungarian Application No. P2000262, filed Aug. 7, 2020, each of which is expressly incorporated by reference herein, in its entirety.

TECHNICAL FIELD

The invention relates to a shading structure.

BACKGROUND ART

In the prior art a number of different shading structures are known that, depending on their field of application, are for example adapted to be applied as umbrellas or parasols, and typically have a collapsible and openable (extendable) configuration.

An example of the most frequently applied configuration of shading structures (umbrellas, parasols) is the document GB 189809487 A, disclosing a mechanism that can be opened or closed utilizing a plurality of actuating arms (stretchers) affixed to a common rod. The large number of actuating arms introduces a lot of failure possibility, for example the wind can easily catch the assembly in the open state, overloading the actuating arms, which can lead to the apparatus becoming unusable. A disadvantage of these solutions is that the mechanism realized applying actuating arms limits the range of possible shapes of the canopy, i.e. the mechanism can only be implemented applying a polygonal canopy, and the complexity of the mechanism is increasing as the number of corners of the polygonal shape increases, which furthermore increases the number of failure modes. Additional disadvantage is that the canopy can become unevenly wrinkled or creased during the folding or roll-up process, which may cause damage to the material of the canopy.

The prior art also includes technical solutions comprising non-polygonal canopies. Examples of this type of technical solution are disclosed in the documents WO 95/03724 and DE 10 2004 010 582 B4. The canopies applied in the technical solutions disclosed in these documents comprise flexible stiffening along the edges, which allows for realizing assemblies having arcuate canopies. The disadvantages of these solutions are that the canopy can be folded only by deforming the flexible stiffeners, and that the mechanism remains bulky even in the closed state. Besides that, collapsing the canopy requires a complex sequence of movements, wherein the assembly is also unable to protect itself by collapsing itself in high winds. Another disadvantage is that to enable the closing of the mechanism the support means of the mechanism either have to be removable, or at the price of further complexity have to be foldable to a smaller size.

Other solutions are also known in the prior art for folding surfaces with complex shape. The technical solution disclosed in the document U.S. Pat. No. 6,834,465 B2 is adapted for folding and opening complex three-dimensional curved surfaces by applying simple scissor assemblies. This assembly has the disadvantages that the scissor assemblies cannot form a part of the folded surfaces, and that there remain non-folded parts even in the folded state of the structure. According to this solution, protection against high winds can only be implemented by applying an auxiliary assembly.

In the document U.S. Pat. No. 4,347,862 a quadrangular canopy is disclosed that is stretched by two transversely arranged bow-like stretcher members.

The document U.S. Pat. No. 4,607,653 discloses a collapsible umbrella with a round rim, comprising a stiffener arranged in the rim. In the closed position, the stiffeners extending inside the rim are aligned closely beside the principal shaft, running near-parallel to it, however, the material of the canopy is not rolled up around the shaft.

The document U.S. Pat. No. 5,355,902 also discloses a collapsible umbrella with a circular rim wherein the canopy material is affixed to a flexible loop member. In the stretched (opened) position the umbrella has a spherical-section shape, the loop member is folded onto itself when the umbrella is in the closed position.

The umbrella according to the document DE 202 10 082 U1 does not comprise ribs, instead the elastic material of the umbrella is affixed to a frame extending along the rim of the umbrella and to a ring disposed around the shaft. The frame of the umbrella consists of articulately coupled segments so it is collapsible and withstands the effects of wind.

The document DE 203 19 961 U1 discloses a collapsible umbrella wherein the canopy material is affixed to at least two arcuate (curved) frame members. In the document such an umbrella configuration is also disclosed, wherein intermediate umbrella sections are put between multiple umbrellas arranged beside each other, which allows for creating an especially large-sized continuous surface.

Technical solutions are also known in the prior art for folding up or rolling up surfaces in a gentle manner. The gentle collapsing of conventionally arranged assemblies is typically implemented by applying auxiliary mechanical arrangements, such as in the documents JP 10-327918 and CN 108703452 A. The disadvantage of these solutions is that the auxiliary mechanical arrangements increase the complexity of the assembly, and therefore the number of possible failure modes.

There are also known among the assemblies arranged differently than the classic umbrella arrangement further technical solutions that are adapted for folding the canopy surface in a more gentle manner, i.e. avoiding at least sharp folding edges when folding the canopy surface. Such a technical solution is disclosed for example in the document EP 0 865 557 B1, wherein a square-shaped surface is folded over an axis extending along the diagonal of the square. In a similar vein, a surface can be rolled up without sharp folding lines not only around a diagonal, but around any axis that at least locally forms a part of the surface, as it is exemplified in the document U.S. Pat. No. 4,068,673. The disadvantage of this latter solution is that the surface has to be folded on or rolled up around an axis that is at least locally embedded in the surface, so the mechanism adapted to carry out the roll-up operation will necessarily always be a separate structural unit. The roll-up axis at least partially embedded in the surface cannot be combined for example with a support means of which the axis (if it exists) usually intersects the surface, most frequently being perpendicular thereto. Furthermore, in the case of such technical solutions the additional arms (stretchers) or external support means required for stretching the canopy surface result in a structural complexity similar to the conventional umbrella mechanisms, while not allowing for applying varied shapes and not providing protection against the wind (without an auxiliary mechanism).

Other umbrella mechanisms having a non-classical arrangement are also capable of gently folding or rolling up the canopy, even in case the folding or roll-up axis does not have a section forming a part of the surface. A mechanism of such a type is disclosed in the document U.S. Pat. No. 1,833,004. This mechanism has the disadvantage that the surface can be stretched only by means of arms made of special elastic material, because the arms also have to be rolled up around the roll-up axis when the surface is folded up. This results in a roll-up or wrapping process similar to certain generic folding or wrap-up solutions that are for example disclosed in the document U.S. Pat. No. 3,848,821. Such types of folding are most frequently applied in spacecraft technology, as it is mentioned also in the documents U.S. Pat. No. 8,356,774 B1, WO 91/08949 and U.S. Pat. No. 3,010,372. A similar type of folding is used for sunshade covers for cars, however, in such cases the requirement of gentle folding the surface is not fully met, and the mechanism is also not able to stretch out the surface; see for example the solution disclosed in the document U.S. Pat. No. 10,232,696 B1. In the case of such foldings or roll-ups it is always necessary to utilize special elastic materials, because the stiffeners adapted for stretching out the surface have to be rolled up around the folding axis. This technical solution has the disadvantage that applying easily foldable, elastic materials it is very difficult to provide the degree of stability that is required for supporting large-size surfaces; this is why this solution is typically applied for small-sized surfaces or in weightlessness (i.e. in space). Furthermore, the result of the folding (the collapsed or closed state) is typically bulk-like, so for example it cannot form a part of a pole; this will result in a shape in the closed state which it more difficult to store than a rod-like shape having a near-uniform diameter. Still, the range of shapes of the canopies that can be implemented with this type of assembly is limited; an arbitrary open shape cannot be realized, and the assembly can only be protected adequately against the wind by additional, more complex structures.

The prior art also includes mechanisms adapted to withstand the effects of wind, or to prevent wind damage, in which mechanisms protection against the adverse effects of wind are provided by auxiliary mechanisms. Such an auxiliary device is disclosed for example in the document KR 10-2052277 B1. This solution has the disadvantage that it introduces extra complexity, while a gentle folding or roll-up of the surface is not provided. In the document KR 10-1377432 B1 a technical solution similar to the previously reference one is disclosed, however, instead of a mechanical auxiliary device it comprises an electrical device that limits the fields of application of the solution and the sites where it can be installed.

An assembly having a configuration different from the classic umbrella mechanism is disclosed in the document WO 2004/030487 A1. This technical solution is adapted to collapse, protecting itself, under the effect of high winds, without increasing the complexity of the mechanism; however, it still allows for implementing only limited polygonal shapes, with a large portion of the surface remaining free and exposed to potential damage after the mechanism has closed itself.

The document U.S. Pat. No. 3,252,469 discloses a collapsible umbrella comprising a stiffened frame (rim) and a canopy having a hyperbolic paraboloid shape. The umbrella material can be rolled up around a shaft extending perpendicular to the material. Thanks to its shape, the umbrella is turned in wind such that it does not turn inside out under the effect of wind as conventional umbrellas often do.

The document US 2006/0278261 A1 discloses a collapsible umbrella comprising ribs, wherein one of the ribs is affixed by a rope to the upper part of the shaft such that is lifts one of the corners of the umbrella. A sail is stretched between the canopy material and the rope, wherein the sail is adapted for turning the umbrella in a proper direction to allow air to flow out from under the umbrella at the lifted-up corner thereof.

DESCRIPTION OF THE INVENTION

In light of the known technical solutions there is a need for a shading structure that can be implemented by applying a canopy having an arbitrary shape, has a simple configuration allowing for easy opening and closing, and is less prone to failure in comparison to conventional technical solutions.

The primary object of the technical solution according to the invention is to provide a shading structure that can be realized by applying a canopy with an arbitrary shape, for example a canopy having a circular or a three-dimensional shape, the shading structure has a closed state having a compact arrangement, and the canopy is rolled up in the closed state in a simple and gentle manner.

A further object of the invention is to provide a shading structure that has a configuration enabling easy opening and closing (collapsing), and wherein the roll-up of the canopy during the closing process and the unrolling thereof during the opening process is realized in a gentle manner, reducing the chance of a damage to the material of the canopy.

Another object of the invention is to provide shading structures that can be arranged beside one another in their open state, their canopies being fitted against each other, such that the mutually adjacent shading structures can be opened and closed independently of each other, i.e. they do not hamper each other's opening and closing processes.

A still another object of the invention is to provide a shading structure that simplifies the design process of shading structures having complex shapes by applying multiple simple segments.

The objects according to the invention have been achieved by providing the shading structure according to claim 1. Preferred embodiments of the invention are defined in the dependent claims.

An advantage of the shading structure according to the invention is that it can be realized by applying a canopy with an arbitrary shape, i.e. the shape of the canopy is not restricted to polygonal shapes; a shading structure according to the invention having a circular canopy can also be achieved by using.

Another advantage of the shading structure according to the invention is that due to its simple structural configuration it is less prone to failure compared to conventional umbrella or parasol solutions, while it also resists better to external forces, for example the effects of wind, and the structure is also less vulnerable to wind damage.

A further advantage is that in certain preferred embodiments of the shading structure according to the invention the canopy can be rolled up gently, without any wrinkles or creases. We have recognised that it is possible to roll up the canopy in a more gentle manner, i.e. without wrinkling or creasing the canopy surface compared to known technical solutions, preventing the associated damage or wear, if the canopy is continuously kept stretched out during the roll-up process. When loose, non-stretched surfaces are rolled up, it is almost certain that wrinkles or creases are rolled up on each other, resulting in a wear and damage, of the canopy material, thus shortens the service life of the shading structure.

We have also recognised that by applying the shading structure according to the invention the canopy roll-up process and the closing process of the shading structure can be carried out simultaneously; in essence the roll-up of the canopy results in the closing (collapsing) of the shading structure, which enables simpler and faster application of the shading structure.

A further advantage of certain embodiments of the shading structure is that under the effect of external forces, for example in high winds, the shading structure is capable of closing (collapsing) itself by rolling up the canopy, protecting the shading structure from a potential damage.

BRIEF DESCRIPTION OF THE DRAWINGS

Preferred embodiments of the invention are described below by way of example with reference to the following drawings, where.

MODES FOR CARRYING OUT THE INVENTION

Figure 1:
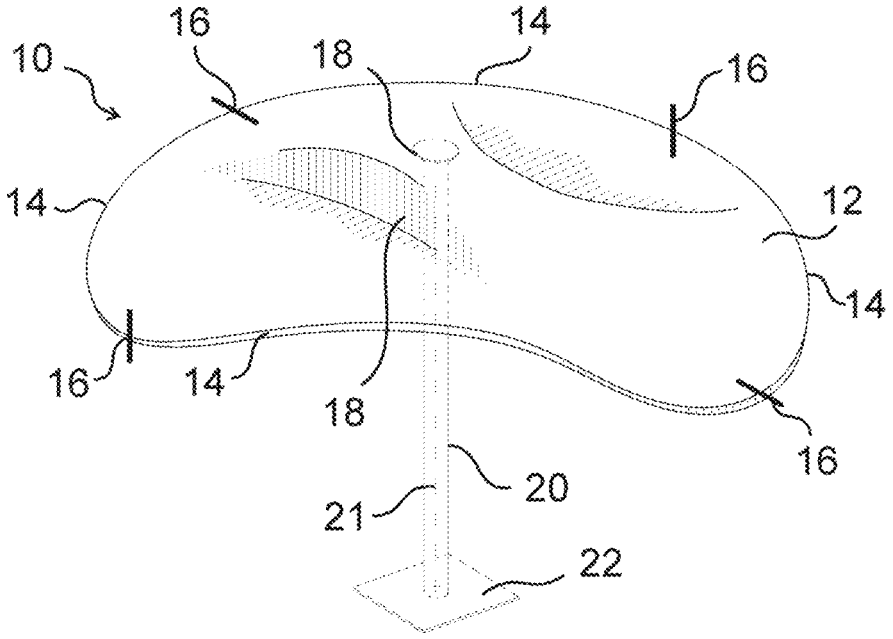
FIG. 1 is a perspective view of a preferred embodiment of the shading structure according to the invention, showing the shading structure in its open state.

In the figures, components having the same functions are denoted with the same reference numerals; however, their exact implementation may be different for example in different embodiments.

Figure 2:
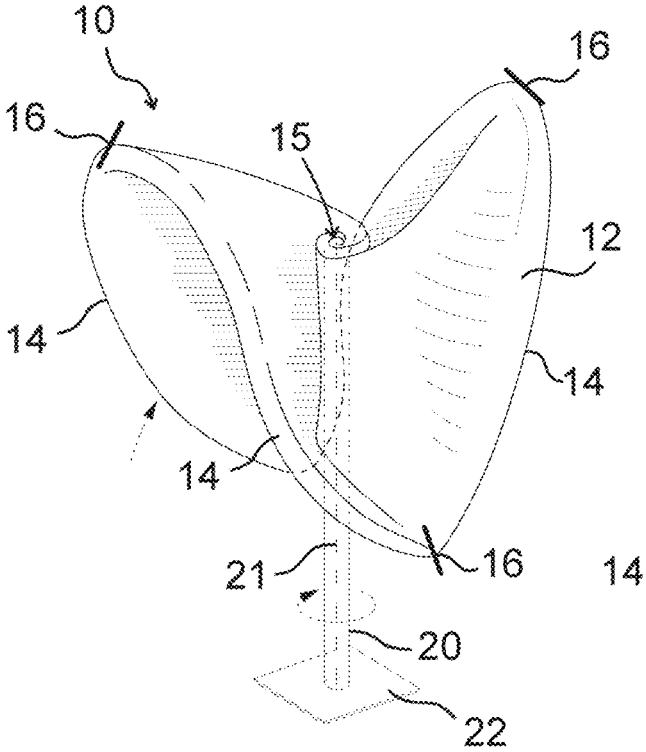
FIG. 2 is a perspective view of the shading structure according to FIG. 1, during the closing process.
Figure 3:
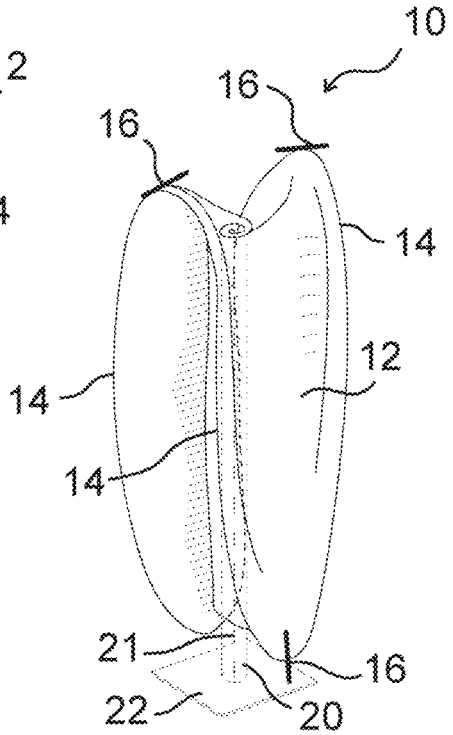
FIG. 3 is a perspective view showing the shading structure according to FIG. 1 in its closed state.

FIGS. 1-3 show perspective views of a preferred embodiment of the shading structure 10 according to the invention. The shading structure 10 has an open state and a closed state; FIG. 1 illustrates the open state, FIG. 3 the closed state, while FIG. 2 shows an intermediate state occurring during the closing process. The shading structure 10 comprises on the one hand a canopy 12 that is affixed to the rest of the shading structure 10 at at least two attachment places 18 (or in other words: attachment locations), on the other hand comprises at least two stiffening sections 14 arranged along a periphery of the canopy 12, wherein the stiffening sections 14 are interconnected by means of articulating members 16, and wherein the canopy 12 is stretched by means of the stiffening sections 14 interconnected by the articulating members 16 in the open state of the shading structure 10.

The embodiment of the invention that is illustrated in FIG. 1 has a canopy 12 having a three-dimensionally curved circular shape, the canopy 12 comprising peripherally arranged stiffening sections 14. In the embodiment shown in the figure, the stiffening sections 14 have an arcuate shape and, depending on the particular application, are preferably formed of rigid or elastic material. The stiffening section 14 can be affixed to the canopy 12 in any suitable manner, for example by means of stitching or adhesive fixing, or alternatively the stiffening section 14 can be implemented as an integral portion of the canopy 12, for example by thickening the material of the canopy 12 along its periphery. Adjacent stiffening sections 14 are coupled to each other by means of respective articulating members 16, wherein the stiffening sections 14 coupled together by the articulating members 16 are arranged preferably at least a portion of the circumference of the canopy 12, or more preferably, along the entire circumference of the canopy 12. In the open state of the shading structure 10 the canopy 12 is stretched out by the stiffening sections 14 coupled together by the articulating members 16. The articulating members 16 can be implemented applying a conventional articulating mechanism, by thinning out or forming a discontinuity of the material, by applying an elastic intermediate piece, or by applying any other flexible component.

In the preferred embodiment according to FIG. 1, the shading structure 10 comprises four stiffening sections 14 that are arranged continuously along a rim of the canopy 12, wherein the adjacent stiffening sections 14 are coupled together by means of articulating members 16. Further preferred embodiments of the shading structure 10 according to the invention comprise more or fewer stiffening sections 14 and articulating members 16 than what is shown in the figure, preferably an even number of stiffening sections 14 and articulating members 16.

The canopy 12 of the shading structure 10 according to the invention comprises at least two attachment places 18. The attachment places 18 define an axis of rotation 21, wherein the canopy 12 is rolled up around the axis of rotation 21 in the closed state of the shading structure 10. In the open state of the shading structure 10, the stiffening sections 14 are skew with respect to the axis of rotation 21, i.e. the stiffening sections 14 are not directly connected to the axis of rotation 21, however, during the closing process of the shading structure 10 the stiffening sections 14 are rotated such that they become aligned with the direction of the axis of rotation 21, and in the closed state of the shading structure 10 the stiffening sections 14 extend in the direction of the axis of rotation 21 while the canopy 12 is rolled up around the axis of rotation 21. In the preferred embodiment according to FIG. 1 the stiffening sections 14 and the articulating members 16 are situated beside, adjacent to the axis of rotation 21 in the closed state of the shading structure 10.

In the preferred embodiment according to FIGS. 1-3 the shading structure 10 has two attachment places 18, a pole 20 and a base 22, wherein the canopy 12 is affixed to the pole 20 at the two attachment places 18. Preferably, the attachment places 18 are inside places (points) of the canopy 12, and preferably the axis of rotation 21 defined by the attachment places 18 extends in the vertical direction, or in a direction lying at an angle of not greater than 90 degrees with respect to the vertical (i.e. an acute angle). The pole 20 preferably provides support to the shading structure 10, while the base 22 attached to the pole 20 ensures the stability of the shading structure 10. If the base 22 is not included, the shading structure 10 can be affixed for example in the ground or in another support member and, if the shading structure 10 is applied as an umbrella or a hand-held parasol, the base 22 can also be replaced with a handle (not shown).

The axis of the pole 20 preferably coincides with the axis of rotation 21 and, in the closed state of the shading structure 10 the canopy 12 is rolled up around the pole 20. The stability of the rolled-up canopy 12 is thereby ensured by the pole 20 in the closed state of the shading structure 10.

The closing process of the shading structure 10 is illustrated in FIG. 2, showing preferred embodiment of the shading structure 10 according to FIG. 1 in a state between the open state and the closed state.

The shading structure 10 can be closed through rotation about the axis of rotation 21. When the stiffening sections 14 are rotated about the axis of rotation 21, mutually adjacent articulating members 16 are displaced in opposite directions, preferably up and down, with respect to their positions in the open state. Under the effect of the oppositely displaced articulating members 16 the shading structure 10 closes, the stiffening sections 14 get aligned with each other and with the direction of the axis of rotation 21, and the canopy 12 is rolled or folded up around the axis of rotation 21. In the closed state of the preferred embodiment of the shading structure 10 according to FIGS. 1-3, the arcuate stiffening sections 14 are arranged next to the axis of rotation 21, but due to their shape they are not able to be aligned parallel to the axis of rotation 21; however, stiffening sections 14 with a straight configuration are expediently aligned parallel to the axis of rotation 21 in the closed state of the shading structure 10.

The shading structure 10 preferably comprises a pole 20 adapted for supporting and holding the canopy structure. The axis of the pole 20 preferably coincides with the axis of rotation 21 defined by the attachment places 18, therefore the canopy 12 is rolled up around the pole 20 in the closed state of the shading structure 10 (see FIG. 3). In the closed state of the shading structure 10, the stiffening sections 14 are aligned with the direction of the axis of rotation 21 and the pole 20.

FIG. 2 illustrates an intermediate state of the shading structure 10 that occurs between the open state and the closed state, wherein the canopy 12 is only partially rolled up around the axis of rotation 21. Since in the preferred embodiment according to FIGS. 1-3 the axis of the pole 20 coincides with the axis of rotation 21, the shading structure 10 can also be closed (collapsed) by rotating the pole 20 about its own axis, or in an identical manner, by rotating the stiffening sections 14 coupled together by the articulating members 16 about the pole 20.

FIG. 3 illustrates the completely closed state of the shading structure 10. In the closed state the stiffening sections 14 are arranged to the axis of rotation 21, and every second articulating member 16 of the members interconnecting the stiffening sections 14 is displaced in the same direction with respect to their position in the open state. The canopy 12 is rolled up, preferably accurately and gently, around the axis of rotation 21 that in the example according to the figure also coincides with the axis of the pole 20. By rolling up the canopy 12 gently it is meant that the rolled-up canopy 12 does not have wrinkles and such regions that are locally subjected to forces, for example tensile or shearing forces overly exceeding an average, normal force value.

Figure 4:
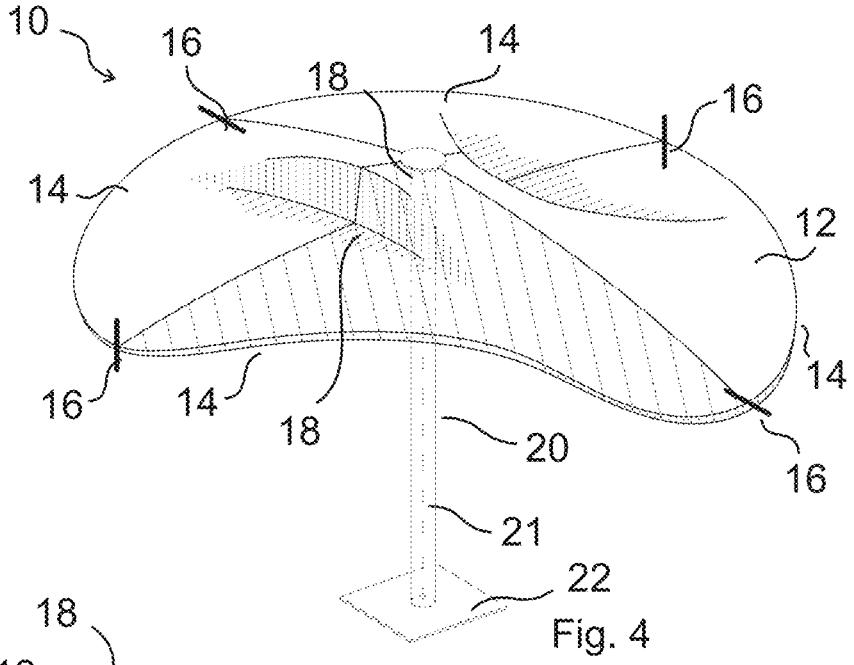
FIG. 4 shows a perspective view of the shading structure according to FIG. 1 in its open state, indicating the segments of the shading structure.

FIG. 4 shows a preferred embodiment of the shading structure 10 according to the invention that was described in detail in relation to FIG. 1, emphasizing a particular single segment of the canopy 12 of the shading structure 10 (see the hatched region). A segment of the canopy 12 is the region of the canopy 12 that is bounded by straight line segments extending from at least one attachment place 18 to two adjacent articulating members 16; the segment also includes the stiffening section 14 arranged between the two articulating members 16 if there is a stiffening section 14 arranged between the particular articulating members 16. The segments typically have triangular, circular sector or other similar shape, depending on the shape of the canopy 12 and the stiffening sections 14. If the stiffening sections 14 bounding the segment are not straight, then the segment will always have a portion that cannot be rolled up around the axis of rotation 21.

Figure 5:
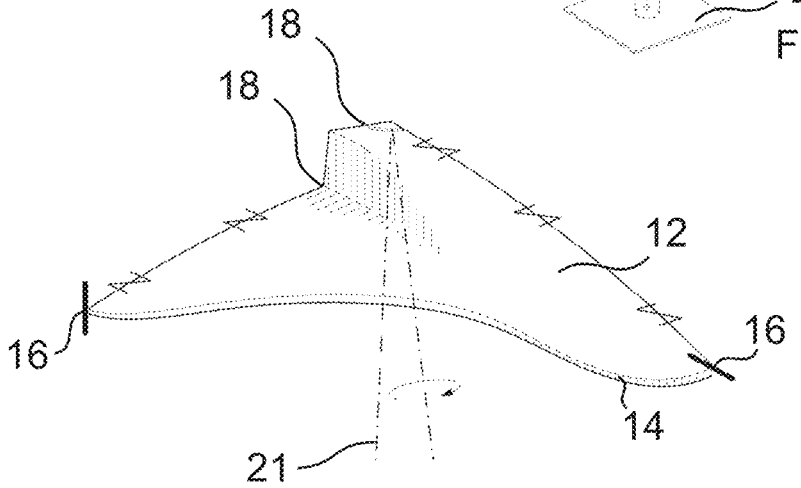
FIG. 5 is a schematic drawing of a single segment of the shading structure according to FIG. 4, also showing the axis of rotation.

FIG. 5 illustrates the segment indicated in FIG. 4, also showing the axis of rotation 21 and the axis of the displacement of the stiffening section 14. By rotating the axis of rotation 21 the stiffening section 14 undergoes rotation to get aligned with the direction of the axis of rotation 21. If the stiffening section 14 has a straight line shape, then it rotates to a direction parallel to the axis of rotation 21 during the closing process of the shading structure 10, but the arcuate stiffening section 14 configured according to FIG. 5 also gets aligned with the direction of the axis of rotation 21 such that the axis of rotation 21 and the stiffening section 14 lie approximately in the same plane.

Figure 6:
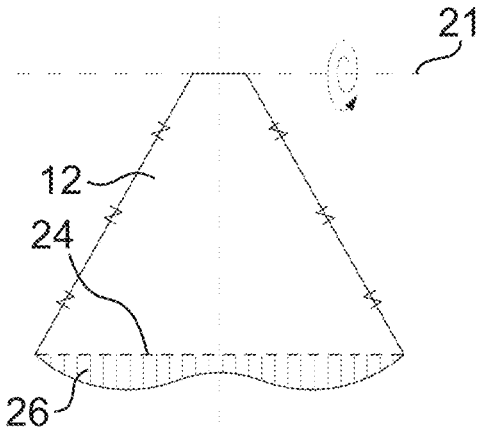
FIG. 6 is a schematic drawing illustrating a single segment of a preferred embodiment of the shading structure according to the invention in order to show the roll-up direction.

FIG. 6 shows a plan view of a segment similar to the segment according to FIG. 5, in the state wherein the stiffening section 14 has almost completed turning to the direction of the axis of rotation 21. The roll-up process of the segment (around the axis of rotation 21) is always started from the attachment place 18, progressing towards the rim of the canopy 12, i.e. the stiffening sections 14. If the stiffening section 14 has an arcuate configuration, then, as discussed above in relation to FIG. 4 the canopy 12 will always have a region 26 (marked in hatched fill) that cannot be rolled up around the axis of rotation 21. The size of the non-roll-up region 26 is affected by the shape and the flexibility of the stiffening section 14; the boundary line of the region 24 that can be rolled up is always a straight line within a single segment.

Figure 7:
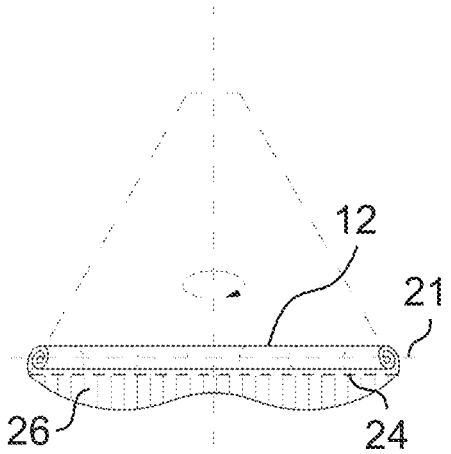
FIG. 7 is a schematic drawing showing the segment according to FIG. 6 in the rolled-up state.

FIG. 7 illustrates the segment shown in FIG. 6 in the rolled-up state that the segment assumes in the closed state of the shading structure 10. In the closed state of the shading structure 10, starting from the boundary line 24 the non-roll-up region 26 extends away from the axis of rotation 21, or, if the shading structure 10 also comprises a pole 20 extending in the direction of the axis of rotation 21, from the pole 20. Because the canopy 12 is rolled up starting at the attachment places 18, the portions of the canopy 12 being close to the attachment places 18 are rolled up tightly around the axis of rotation 21 or the pole 20; however, towards the stiffening sections 14 the roll-up is getting more gentle because the material of the canopy 12 is rolled up at a progressively greater diameter resulting in fewer layers of material.

Figure 8:
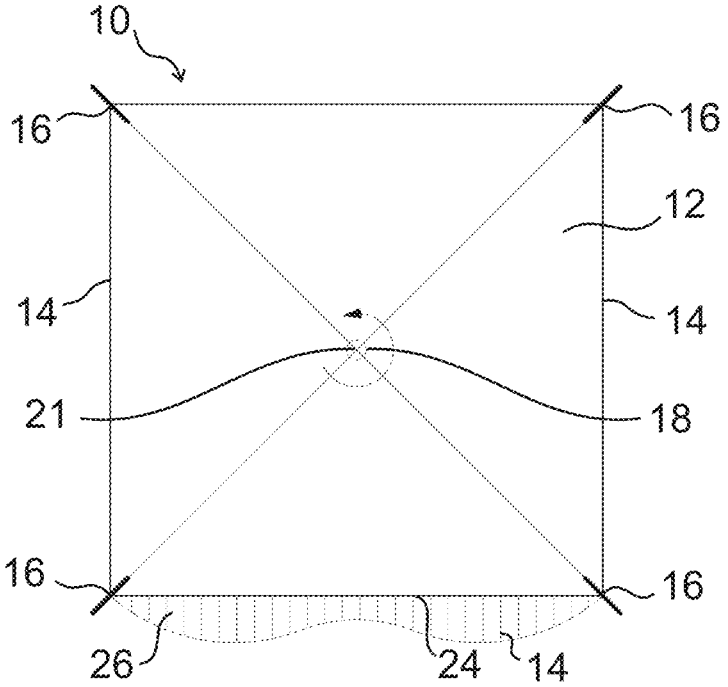
FIG. 8 is the top plan view of a preferred embodiment of the shading structure according to the invention.
Figure 9:
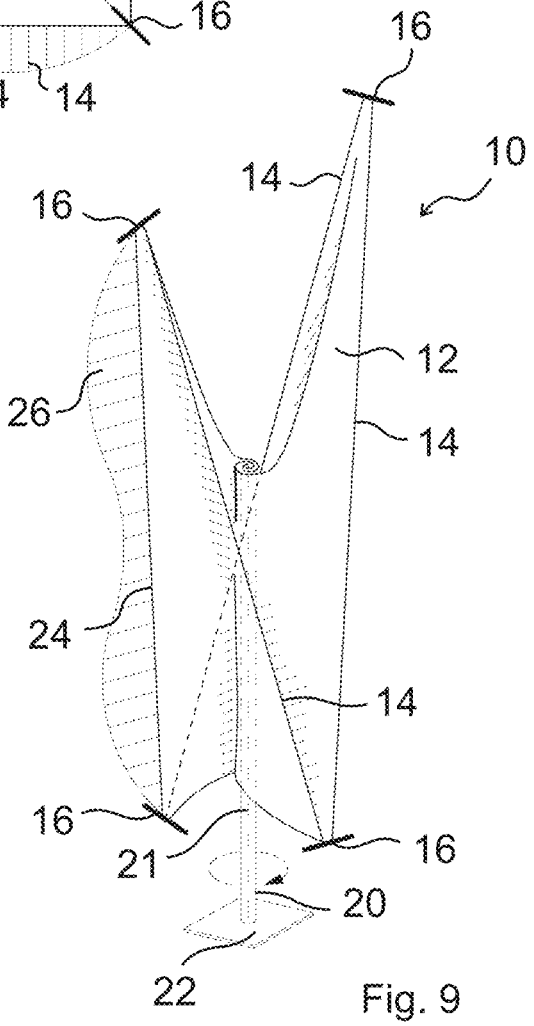
FIG. 9 is a perspective view showing the shading structure according to FIG. 8 in a nearly closed state.

In FIGS. 8-9 another preferred embodiment of the shading structure 10 according to the invention is shown; FIG. 8 showing a top plan view of the shading structure 10 in the open state and FIG. 9 illustrating the shading structure 10 in a nearly closed state, in a perspective view. In this preferred embodiment the canopy 12 of the shading structure 10 consists of four segments (see FIGS. 4-7), wherein three of the segments have a triangular shape and the fourth segment has an arcuate outer rim corresponding to the shape of the canopy 12. For the same reasons, of the stiffening sections 14 arranged along the rim/periphery of the canopy 12 three sections are straight, while one section has an arcuate configuration. The adjacent stiffening sections 14 are coupled together by articulating members 16, wherein articulating members 16 are implemented for example by thinning out the material of the stiffening sections 14 or by applying other known articulating members or mechanisms. The stiffening sections 14 coupled together by means of the articulating members 16 preferably form a Bennett mechanism, and are adapted to stretch out the entire canopy 12.

A region 26 of the canopy 12 surface that cannot be rolled up is marked in the figure in hatch fill, while the rest of the canopy 12 can be rolled up around an axis of rotation 21 that crosses the attachment place 18 of the canopy 12.

In a further preferred embodiment of the shading structure 10 according to the invention any of the segments of the shading structure 10 may comprise a stiffening section 14 having an arcuate shape corresponding to the shape of the canopy 12. Applying stiffening sections 14 of appropriately chosen shape the shading structure 10 can assume different shapes, even figural shapes in the open state and in the closed state. If the area of the canopy 12 is not reduced due to the application of arcuate stiffening sections 14 instead of straight-line ones with respect to the embodiment according to FIG. 8, then the portion of the shading structure 10 that can be folded or rolled up is identical to the foldable/roll-up portion of the shading structure 10 according to FIG. 8. In certain embodiments, the application of arcuate stiffening sections 14 instead of straight-line stiffening sections 14 may make it necessary to arrange the articulating members 16 in other positions in order to allow the canopy 12 to be stretched out in its entirety, and to maximize the area of the portion of the canopy 12 that can be rolled up.

Like with the embodiment according to FIG. 8, a further embodiment can also be realized wherein all segments comprise straight stiffening sections 14, but the canopy 12 has a non-roll-up portion that lies outside the stiffening sections 14 and, in the lack of stiffening, hangs downward from a portion of the canopy 12 that is stiffened by the stiffening sections 14.

FIG. 9 illustrates, in perspective view, a near-closed state of the preferred embodiment shown in FIG. 8. In the closed state of the shading structure 10 the non-roll-up region 26 of the canopy 12 is not rolled up around the axis of rotation 21, or, in the embodiment according to the figure, around the pole 20, therefore the non-roll-up region 26 is in a free-standing state. The closed state of the shading structure 10 illustrated in FIG. 9 mechanically corresponds to the closed state of the preferred embodiment according to FIG. 3.

Figure 10:
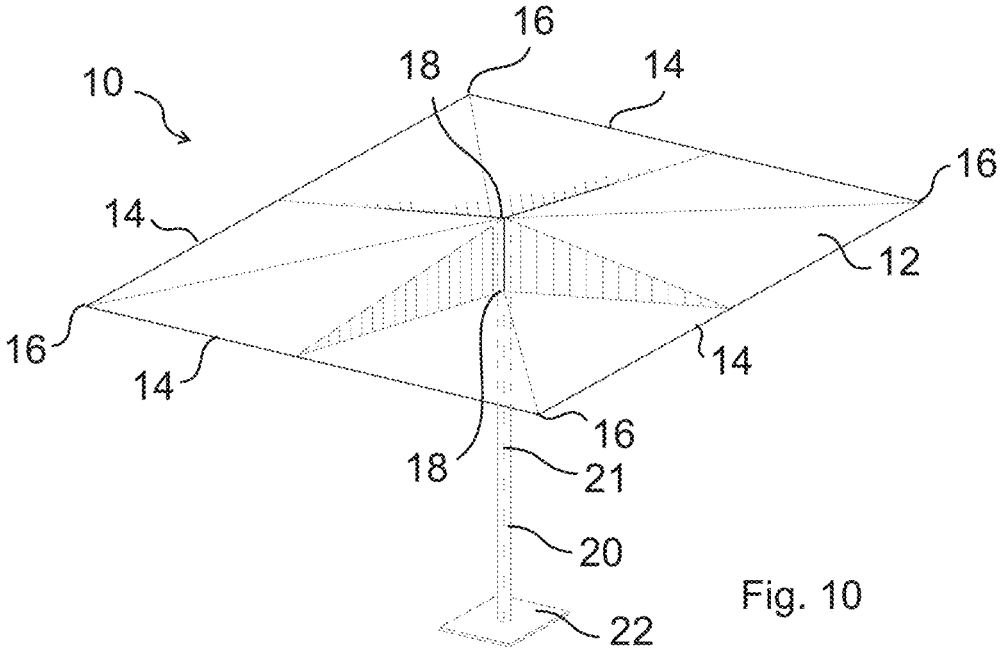
FIG. 10 is a perspective view of another preferred embodiment of the shading structure according to the invention, showing the shading structure in its open state.
Figure 11:
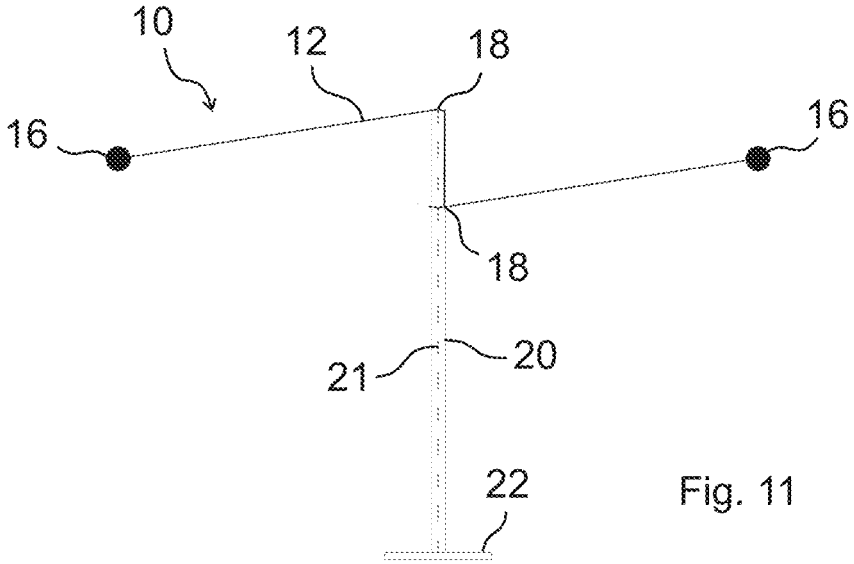
FIG. 11 illustrates a segment of the shading structure according to FIG. 10 in its open state.

FIG. 10 and FIG. 11 illustrate a further preferred embodiment of the shading structure 10 according to the invention, showing, respectively, a perspective view (FIG. 10) and a sectional view (FIG. 11) of the shading structure 10. In this preferred embodiment, the canopy 12 of the shading structure 10 has a quadrangular (square) shape, and a respective stiffening section 14 is arranged along each side of the quadrangle, wherein the stiffening sections 14 are coupled together by articulating members 16. In the preferred embodiment shown in the figures the canopy 12 is formed of a single-layer material, and the canopy 12 has two attachment places 18.

The two attachment places 18 are inside points (places) of the canopy 12 that are located at different vertical levels in the preferred embodiment according to the figure, and thereby define an axis of rotation 21 around which the canopy 12 can be rolled up in the closed state of the shading structure 10. At the attachment places 18 the canopy 12 is preferably affixed to a pole 20, wherein the pole 20 is adapted for supporting and holding the shading structure 10. The axis of the pole 20 expediently coincides with the axis of rotation 21, so in the closed state the shading structure 10 can be rolled up around the pole 20.

In the preferred embodiment according to FIGS. 10-11 the axis of rotation 21 and the pole 20 are oriented vertically, however, in further preferred embodiments the axis of rotation 21 and the pole 20 can also be arranged at an angle (expediently at an acute angle) with respect to the vertical direction.

By securing the single-layer canopy 12 in the manner illustrated in FIGS. 10-11, the canopy 12 is stably stretched out by the stiffening sections 14. In this preferred embodiment of the invention, in the open state of the shading structure 10 the stretched-out canopy 12 does not assume a flat shape, but due to the relative position of the attachment places 18 the canopy 12 assumes a three-dimensional shape in the open state (see the side view of a section of the canopy 12 in FIG. 11, shown in a continuous line), however, this three-dimensional shape of the canopy 12 does not affect the manner of collapsing or closing the shading structure 10. When the shading structure 10 is being closed, the mutually adjacent articulating members 16 are displaced in opposite directions, preferably up and down, with respect to their positions in the open state, and thereby the canopy 12 can be rolled up by rotating the canopy 12 about the axis of rotation 21.

For example, in the case of the canopy 12 is affixed to the pole 20, the shading structure 10 can also be closed by rotating the pole 20 about its axis while simultaneously rolling up the canopy 12 around the pole 20. The shading structure 10 can also be collapsed without rotating the pole 20, after which the canopy 12 can be rolled up around the pole 20 by rotating the pole 20 about its axis.

In the preferred embodiment according to FIGS. 10-11, the shading structure 10 comprises a base 22 connected to the pole 20. If, for example, the shading structure 10 is implemented as an umbrella, then a handle is preferably included instead of the base 22.

The canopy 12 can always be fully collapsed/rolled up in case the shape of the canopy 12 is a concave or convex polygon of which the interior angle bisectors intersect at a single point, which point is at the same time the attachment place 18 of the canopy 12. In general, any such two-dimensional and three-dimensional canopies 12 can be fully rolled up, even around more than one axes of rotation 21, for which it holds true that, for all segment pairs from the segments shown in FIGS. 4-7 that are connected to the same attachment place 18, the angles are identical at the corner of their common side that lies farther away from the attachment place 18. In this case, the entire canopy 12 can be rolled up around the axes of rotation 21 crossing the attachment places 18.

The smaller the difference of the shape defined by the stiffening sections 14 peripherally arranged along the rim of the canopy 12 from a polygon having an even number of sides, wherein the internal angle bisectors intersect at a single point, which intersection point is the attachment place 18 of the canopy 12 that is also crossed by the axis of rotation 21, the smaller (the more compact) the collapsed size of shading structures 10 having two attachment places 18. In the case of three-dimensional surfaces this constraint has to be applied for the individual segments; shading structures 10 comprising more than one axes of rotation 21 can be interpreted as integrated devices comprising more than one shading structures 10 each having a single axis of rotation 21.

For example, the shapes that can be fully rolled up include a square, a rhombus, a regular hexagon, a regular octagon, etc., as well as an equilateral triangle (see the preferred embodiment according to FIGS. 23-26), and an isosceles triangle (see FIG. 14—which can also be interpreted as integrating two shading structures 10 comprising a canopy 12 with an isosceles triangle shape), a hyperbolic paraboloid (saddle surface) bounded by line segments of identical length, a cube, and other three-dimensional surfaces.

Figure 12:
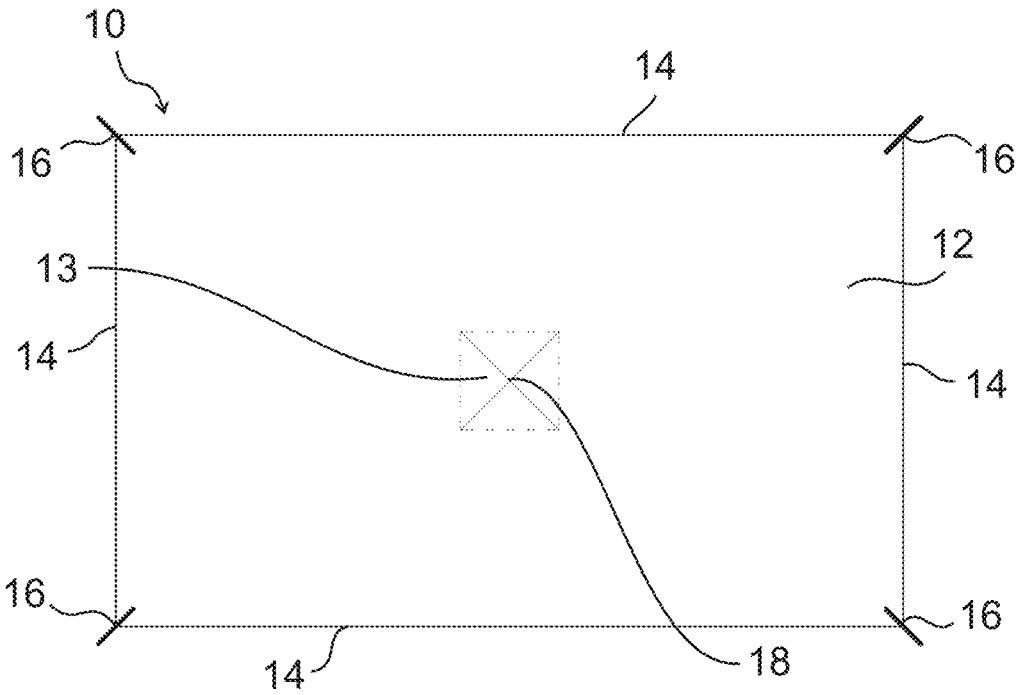
FIG. 12 is a top plan view of another preferred embodiment of the shading structure according to the invention, showing the shading structure in its open state.
Figure 13:
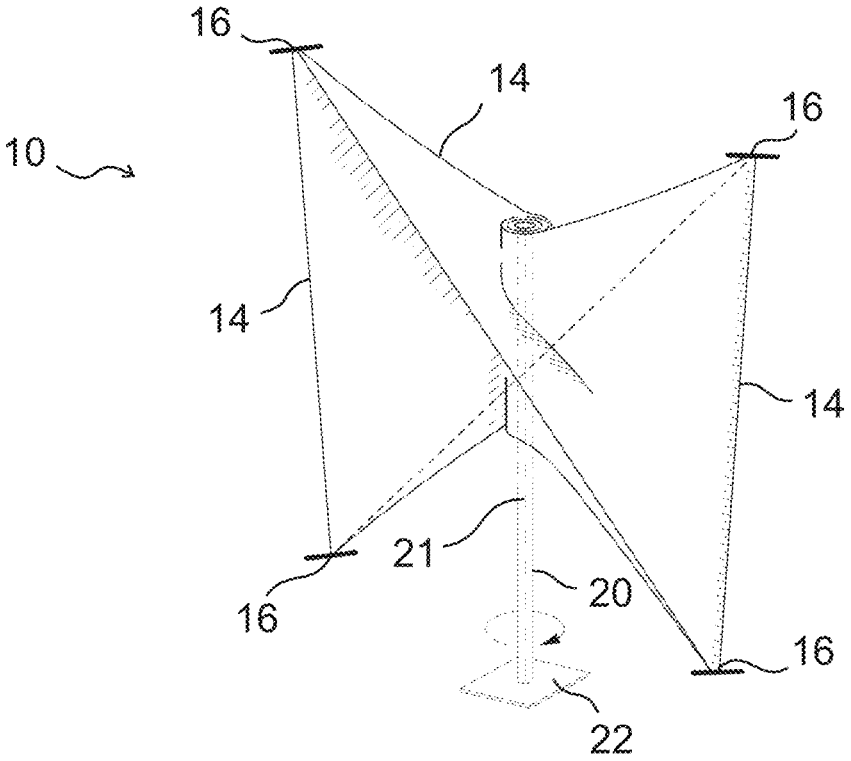
FIG. 13 is a perspective view showing the shading structure according to FIG. 12 in its closed state.

FIGS. 12 and 13 illustrate a further preferred embodiment of the shading structure 10 according to the invention. In this preferred embodiment, the shape of the canopy 12 of the shading structure 10 is quadrilateral, preferably rectangular, and the shading structure 10 comprises stiffening sections 14 arranged peripherally along the rim of the canopy 12. The length of the stiffening sections 14 is preferably identical to the length of the corresponding sides of the rectangular canopy 12, and the stiffening sections 14 are coupled together by articulating members 16 arranged at the corners of the canopy 12. As with the embodiments shown in the above figures, the articulating members 16 are preferably implemented by thinning out the material of the stiffening sections, or as other articulating mechanisms; more preferably the stiffening sections 14 coupled together by the articulating members 16 constitute a system with a single degree of freedom (for example, a Bennett mechanism, see FIGS. 15-20).

In the closed state of the shading structure 10 comprising the rectangular canopy 12 according to FIGS. 12-13 (see FIG. 13) the canopy 12 cannot be fully rolled up around the axis of rotation 21, because, as it was set forth in relation to FIGS. 10-11, the internal angle bisectors of the shape of the canopy 12 or the shape defined by the stiffening sections 14 do not intersect at a single point. In FIG. 12 the boundary of the roll-up region 13 of the canopy 12 is marked by a dashed line drawn around the attachment place 18. The roll-up region 13 has a square shape for which the conditions set forth above in relation to FIGS. 10-11 are fulfilled, i.e. the internal angle bisectors intersect in a single point that is also an attachment place 18 of the canopy 12.

If the canopy 12 has a different attachment place 18 than the one shown in FIG. 12, then the roll-up region 13 of the canopy 12 will be a region around the attachment place 18 having a shape that fulfils the conditions set forth in relation to FIGS. 10-11.

In the embodiment according to FIGS. 12-13 in the closed state of the shading structure 10 the stiffening sections 14 cannot be arranged beside each other in a near-parallel fashion. In such embodiments wherein the stiffening sections 14 are formed of a material capable of elastic deformation, the size of the region 13 that can be rolled up can be increased by bending the stiffening sections 14.

Figure 14:
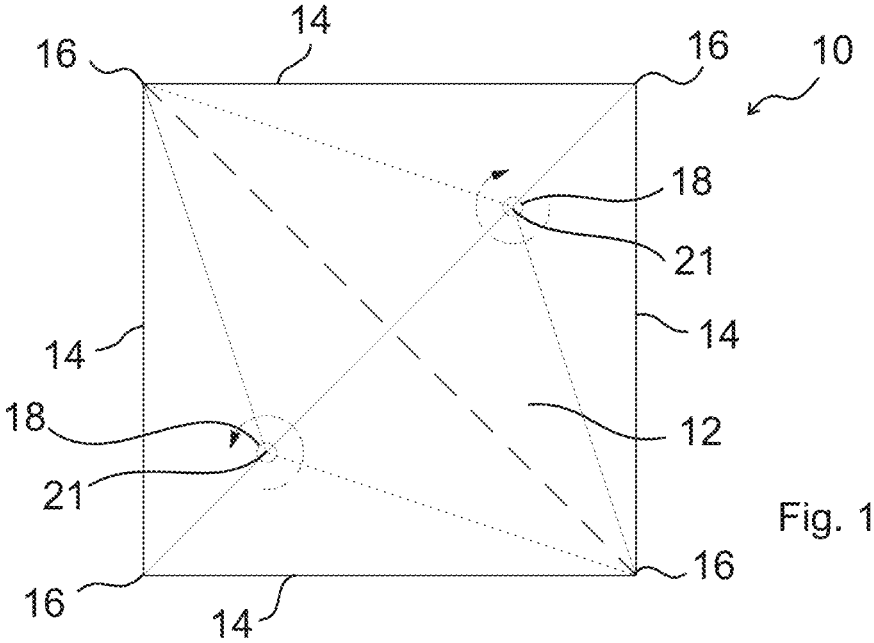
FIG. 14 is a top plan view of another preferred embodiment of the shading structure according to the invention, showing the shading structure in its open state.

FIG. 14 shows the top plan view of a preferred embodiment of the shading structure 10 according to the invention in the open state of the shading structure 10, the canopy 12 of which can be rolled up around two axes of rotation 21 in the closed state of the shading structure 10. In this preferred embodiment the canopy 12 has a square shape, is formed of a single-layer material, and the canopy 12 is affixed to both axes of rotation 21 at a respective attachment place 18.

The shading structure 10 according to FIG. 14 consists of two congruent portions, where the boundaries of the portions are shown in dashed lines in the figure. Each of the congruent canopy-portions has an isosceles triangle shape, comprising stiffening sections 14 only along their equal-length sides, i.e. there are no stiffening sections 14 along the respective base sides of the triangles that are shown in dashed lines in the figure. Accordingly, the entire canopy 12 of the preferred embodiment according to FIG. 14 has stiffening sections 14 only along the edges of the square, the stiffening sections 14 being coupled together by articulating members 16 arranged at the corners of the canopy 12 similar to the preferred embodiment shown in FIG. 10. In contrast to the preferred embodiment shown in FIG. 10, the two attachment places 18 of the preferred embodiment according to FIG. 14 belong to two separate axes of rotation 21, so in the embodiment according to FIG. 14 the deformation of the canopy 12, becoming a three-dimensional surface, shown in FIG. 10 does not appear. The articulating members 16 in this preferred embodiment are also implemented by thinning out the material of the stiffening sections 14, or applying other known articulating mechanisms; more preferably, the stiffening sections 14 coupled together by the articulating members 16 form a Bennett mechanism. The articulating members 16 constituting the Bennett mechanism are preferably located at the corners of a quadrangle; the stiffening sections 14 extending between the articulating members 16 can have a straight or arcuate shape.

By way of example, in FIG. 14, the roll-up directions of the canopy 12 around the axes of rotation 21 are illustrated by arrows. In the preferred embodiment shown in the figure, the canopy 12 can be rolled up around one of the axis of rotation 21 in a clockwise direction, while it can be rolled up around the other axis of rotation 21 in an anti-clockwise direction. The two axes of rotation 21 prevent the stiffening sections 14 from being rotated about the axes of rotation 21, resulting in a stable stretching of the canopy 12 in the open state of the shading structure 10. The inclusion of oppositely rotatable axes of rotation 21 according to the figure further increases the stability of the shading structure 10, especially in the intermediate states occurring between the open state and the closed state.

The shading structure 10 preferably comprises two poles 20, the respective principal axes of which coincide with the axes of rotation 21, and to which poles 20 the canopy 12 is affixed at the attachment points 18. The two axes of rotation 21, and consequently the two poles 20 have a common base point, which base point is located at a vertical projection of a geometric centre of the canopy 12 to a horizontal plane (for example, to the plane of the ground). Thereby, the axes of rotation 21 and the poles 20 are not vertical but extend at a given angle relative to the vertical direction. The value of this angle is determined, as a function of the relative position of the base point and the attachment places 18, by the length of the poles 20. Shorter poles 20 lie at a greater angle to the vertical direction, while longer poles 20 lie at a smaller angle to the vertical direction in the open state of the shading structure 10.

For closing the shading structure 10, the canopy 12 has to be rotated about the axes of rotation 21. If the shading structure 10 comprises poles 20, as the embodiment shown in FIG. 14, having axes coinciding with the axes of rotation 21, then the shading structure 10 can also be closed/collapsed by rotating the poles 20. In the preferred embodiment shown in the figure, at the canopy 12 the poles 20 are located further away from each other, so during the closing process of the shading structure 10 the rotation of the stiffening sections 14 about the attachment places 18 is blocked. During the closing process of the shading structure 10 the axes of rotation 21 and the poles 20 move towards each other about the common base point, and thus in the closed state of the shading structure 10 the axes of rotation 21 and the poles 20 are aligned beside each other, in a near-parallel fashion, wherein the entire canopy 12 is rolled up around the poles 20. The poles 20 are preferably rotatably retained at the base point, which allows the poles 20 to rotate in a direction towards each other during the closing process of the shading structure 10. In another preferred embodiment, both poles 20 have a vertical orientation, and are adapted to come closer to each other during the closing process, moving along a rail or by other means, as the canopy 12 is being rolled up.

In case the shading structure 10 is implemented as a parasol, the shading structure 10 expediently comprises a base 22 (see for example FIG. 15) that is arranged at the base point supporting the shading structure 10. If the shading structure 10 is implemented as an umbrella, then a handle is expediently attached to the base point.

Due to the arrangement of the stiffening sections 14 and the attachment places 18 in the shading structure 10 according to FIG. 14 the canopy 12 has no portion that could become wrinkled during the closing process of the shading structure 10, so the canopy 12 can be rolled up gently, without wrinkles, around the axes of rotation 21, or in embodiments comprising a pole 20, around the pole 20.

FIGS. 15-20 illustrate a preferred embodiment of the shading structure 10 according to the invention having a configuration similar to the configuration of the preferred embodiment shown in FIG. 14. The canopy 12 of this preferred embodiment of the shading structure 10 has a square shape and a two-layer configuration. The two layers of the two-layer canopy 12 are preferably arranged above each other, each layer having two attachment places 18, wherein each pair of attachment places 18 defines a respective axis of rotation 21, and wherein the canopy 12 is rolled up around the axes of rotation 21 in the closed state of the shading structure 10. One of the two attachment places 18 defining each of the axes of rotation 21 one belongs to one of the layers of the canopy 12, while the other attachment place 18 belongs to the other layer, respectively.

The canopy 12 comprises peripherally arranged stiffening sections 14 that are arranged continuously along the rim of the canopy 12, i.e. along the entire circumference of the canopy 12. The stiffening sections 14 are coupled together via articulating members 16 at the corners of the canopy 12, wherein both layers of the canopy 12 are stretched out in the open state of the shading structure 10 by the stiffening sections 14 coupled together by the articulating members 16, as it can be seen in the schematic perspective view of FIG. 15 and also in the sectional view of FIG. 16.

The top plan view of the preferred embodiment according to FIGS. 15-20 is preferably identical to the top plan view of the preferred embodiment according to FIG. 14, and the closing process of the shading structure 10 according to FIGS. 15-20 is identical to the closing process described above in relation to FIG. 14. The closed state of the shading structure 10 according to FIG. 15 can be achieved by applying rotation about the axes of rotation 21, by way of example a clockwise rotation is applied about one axis of rotation 21, while an anti-clockwise rotation is applied about the other axis of rotation 21.

The preferred embodiment according to FIGS. 15-20 preferably comprises two poles 20 adapted for supporting and holding the shading structure 10, the axes of the poles 20 preferably coinciding with the axes of rotation 21. The poles 20 preferably have a common base 22, on which base 22 the shading structure 10, configured for example as a parasol or a sunshade, is adapted to stand stably. In the case of a shading structure 10 configured as an umbrella, a handle is preferably attached to the poles 20 instead of the base 22.

The poles 20 are preferably configured to allow rotation about their own axis and permitting them to be displaced towards each other. By rotating the poles 20 about their axis the shading structure 10 can be brought from the open state into the closed state, and rotation in the opposite direction corresponds to bringing the shading structure 10 from the closed state into the open state. In the closed state of the shading structure 10 both layers of the canopy 12 are rolled up around the poles 20 in a manner that can be regarded as a gentle roll-up described above in relation to FIG. 14.

Figure 17:
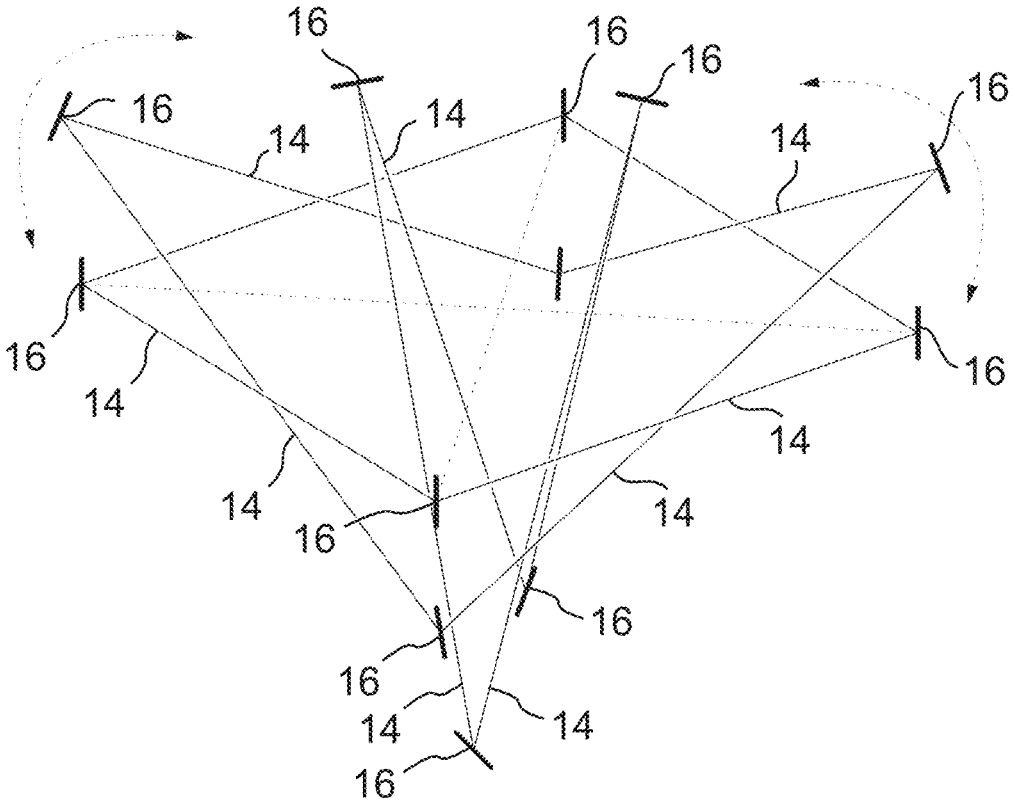
FIG. 17 is a schematic drawing illustrating the movement of the stiffening sections of the shading structure according to FIG. 14 during the closing process of the shading structure.
Figure 18:
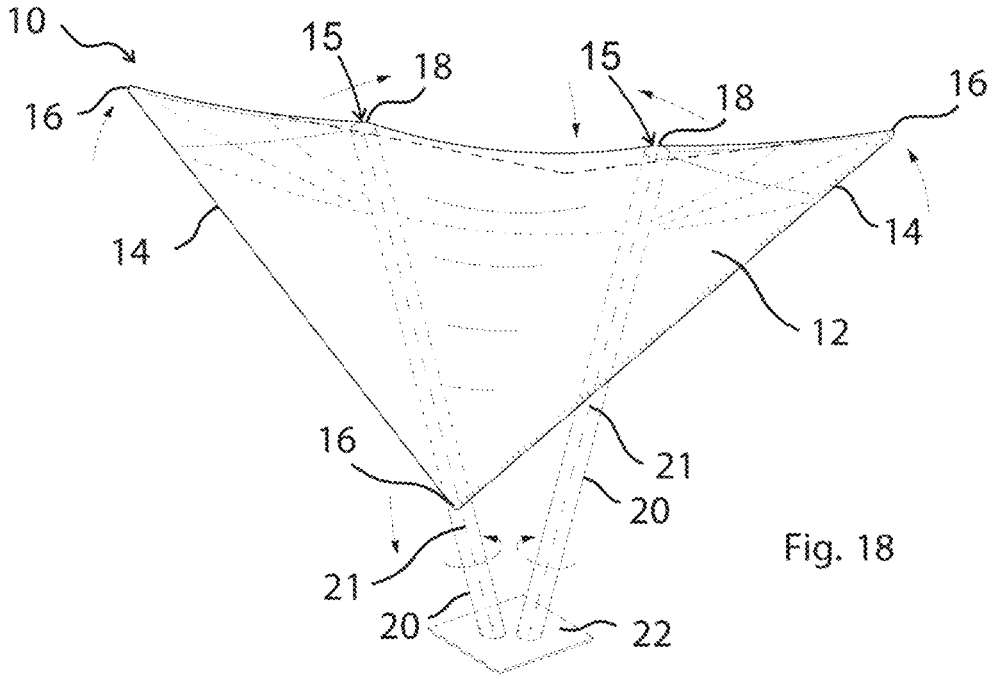
FIGS. 18-20 are perspective views of the shading structure according to FIG. 14 illustrating the intermediate states between the open state and the closed state of the shading structure.
Figure 19:
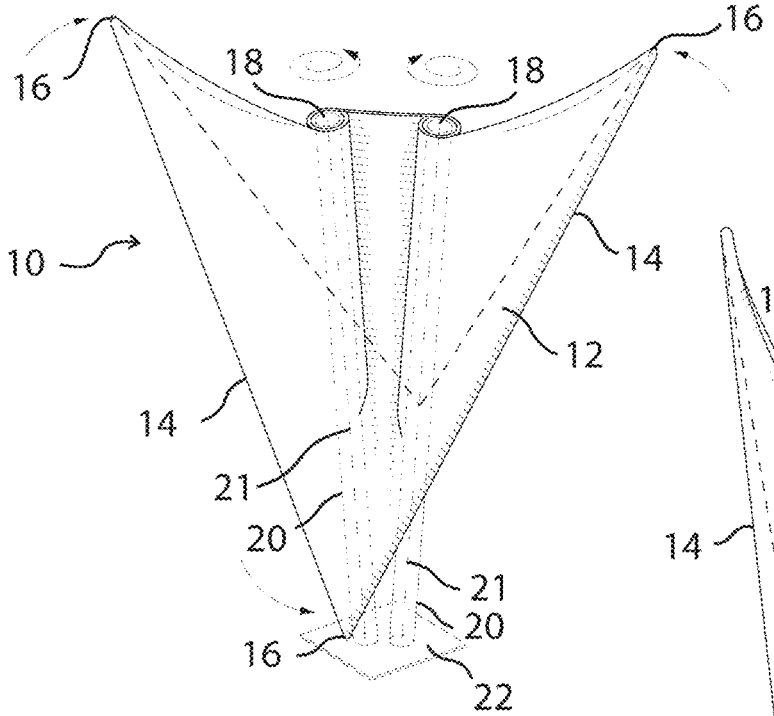
Figure 20:
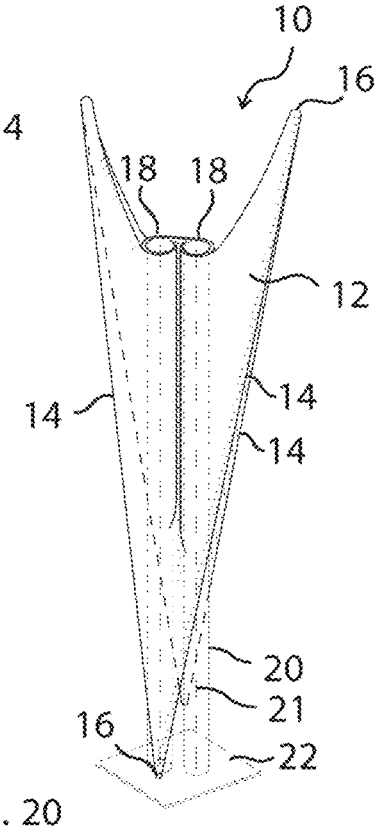

The closing process of the shading structure 10 is depicted in detail in perspective views in FIGS. 18-20, showing intermediate states occurring between the open state and the closed state, while FIG. 17 illustrates the movement of the stiffening sections 14 coupled together by the articulating members 16 in intermediate positions occurring between the open state and the closed state of the shading structure 10.

Figure 15:
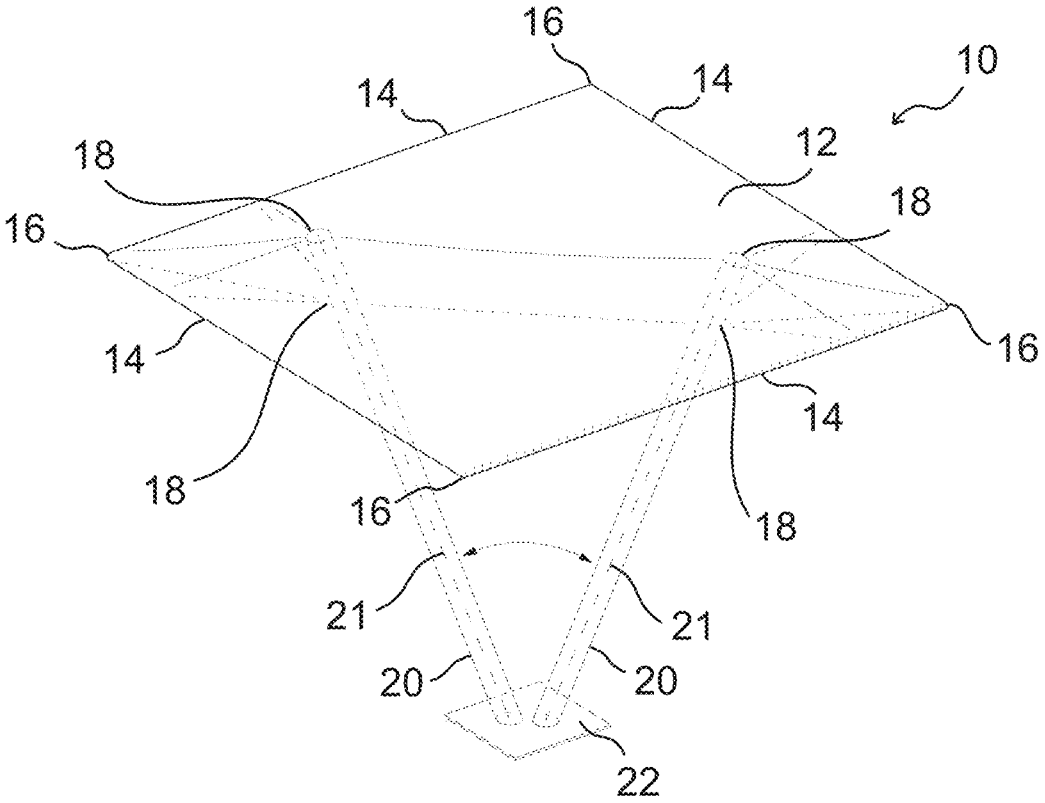
FIG. 15 is a perspective view showing the shading structure according to FIG. 14 in its open state.
Figure 16:
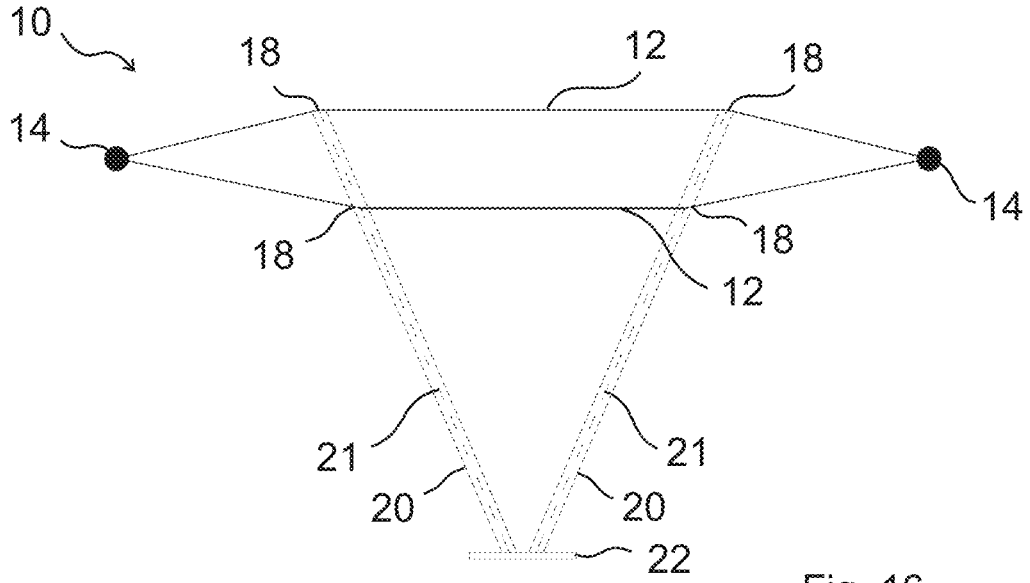
FIG. 16 illustrates a segment of the shading structure according to FIG. 14 in its open state.

FIG. 16 shows a sectional view of the shading structure 10 according to FIG. 15, clearly showing the affixing of both layers of the two-layer canopy 12 at the attachment places 18.

In the preferred embodiments according to FIGS. 15-20 it is the roll-up of the canopy 12 that results in the closing (collapsing) of the shading structure 10. During the closing process the portions of the canopy 12 that are not yet rolled up are kept in a stable, stretched-out position by the stiffening sections 14 coupled together by the articulating members 16, which prevents the stiffening sections 14 from getting displaced, tilted in unwanted directions. It is ensured by this advantageous feature of the shading structure 10 that the shading structure 10 remains stable even during the closing process, and it does not put in danger the persons under or near the shading structure 10.

The movement of the stiffening sections 14 and the position of the articulating members 16 are illustrated in detail in FIG. 17, also indicating the direction of the respective axes of the articulating members 16. The stiffening sections 14 coupled together by the articulating members 16 collectively form a single-degree-of-freedom, four-bar Bennett mechanism that has a constrained mobility and two terminal states. In our case, the two terminal states of the Bennett mechanism are the open state and the closed state of the shading structure 10. A peculiar characteristics of the Bennett mechanism is that the two corner points corresponding to a diagonal of the quadrangle defined by the stiffening sections 14 coupled together by the articulating members 16 are the farthest apart from each other in a state near the open state of the shading structure 10 (i.e. not in the open state thereof). The state wherein the two corner points corresponding to a diagonal of the Bennett mechanism are the farthest apart from each other is an unstable state, i.e. after swinging over this state the Bennett mechanism will assume one of its terminal states, that is, the shading structure 10 will be brought into the open state or into the closed state in case such a resilient means is provided in the canopy 12, in the articulating members 16, in the stiffening sections 14 or in the poles 20 of the shading structure 10, for example by applying a spring, by using the resilience of the material of the canopy 12, or by other means, that is able to pull together the corner points at least as far as in the open state. The typical materials, fabrics currently applied for making canopies 12 are in themselves capable of providing such means. The other two corners of the quadrangle, that are the farthest apart from each other in a position other than the unstable equilibrium position, are continuously getting closer to each other during the closing process of the shading structure 10.

In FIG. 18 there is illustrated the state of the shading structure 10 according to FIG. 15 wherein, as presented in relation to FIG. 17, the two corner points of the Bennett mechanism constituted by the stiffening sections 14 coupled together by the articulating members 16 are the farthest apart from each other. The stiffening sections 14 forming the Bennett mechanism can also be configured in an arcuate fashion instead of having a straight shape. If arcuate stiffening sections 14 are applied, the canopy 12 will however have non-roll-up regions (see FIG. 8).

For easily closing or collapsing the shading structure 10 in a gravitational field, the articulating members 16 that are momentarily drawing away from each other during the closing process are expediently arranged with respect to the canopy 12 that they are displaced upwards when the closing process is initiated. If this structural configuration of the shading structure 10 is applied, then, provided that the shading structure 10 comprises a mechanism adapted for applying rotation to the poles 20 in a continuous manner, the Bennett mechanism, formed by the stiffening sections 14 coupled together by the articulating members 16, has two stable and one unstable equilibrium states. The unstable state is the state of the Bennett mechanism wherein the two corner points that are moving away from each other are the farthest apart from each other. The open state of the shading structure 10 is a state near the unstable equilibrium state of the Bennett mechanism.

If the mechanism adapted for rotating the poles 20 is configured such that the poles 20 are continuously forced to rotate under the effect of a primary mover 15, for example a spring or another moving mechanism, then, by means of the canopy 12, the rotation of the poles 20 will urge the articulating members 16 located at the corners of the Bennett mechanism to move nearer to each other. Due to the motion constraints noted in relation to FIG. 17, the rotation of the poles 20 keeps the shading structure 10 in the open state, i.e. it acts against closing (collapsing) because in the open state of the shading structure 10 the corners of the Bennett mechanism are closer to each other than in the unstable equilibrium position. The rotation of the poles 20 automatically closes (collapses) the shading structure 10, meanwhile also rolling up the canopy 12, once an external effect swings the Bennett mechanism out from the open state and over the unstable equilibrium state. The articulating members 16 are expediently provided with a braking means, for example a viscous brake, that prevents rapid closing of the shading structure 10, or, with sufficiently large shading structures 10 wherein the material of the canopy 12 is a sufficiently closely-woven fabric, the same function can also be achieved by air resistance (drag).

This embodiment of the invention has the advantage that in high winds, storms the shading structure 10 is able to close "on its own" in case the initially open shading structure 10 swings over the unstable equilibrium position of the Bennett mechanism under the force of the wind. In the case of the shading structure 10 is in the closed state having a compact size, the chance of wind damage is lower in the closed state, so by collapsing the shading structure 10 protects itself from getting damaged. If the articulating members 16 are provided with braking means, then the closing process of the shading structure 10 will be slow enough to let the persons staying under or near the shading structure 10 to leave the area under the canopy 12 of the shading structure 10, i.e. to prevent injury.

FIG. 19 illustrates an intermediate state of the shading structure 10 wherein some external forces such as human force or strong wind has been swung out the Bennett mechanism from its unstable equilibrium state, i.e. from the open state to the closed state, and thereby the roll-up process of the canopy 12 around the poles 20 has been started. During the roll-up process the portions of the canopy 12 that have not yet been rolled up are kept stretched out by the stiffening sections 14 coupled together by the articulating members 16, which allows the canopy 12 to be rolled up gently around the poles 20.

FIG. 20 illustrates the shading structure 10 in a near-closed state. For bringing the shading structure 10 from the closed state into the open state an external force, for example a force applied by a user, is required. For opening the shading structure 10, one of the articulating members 16 of the shading structure 10 has to be moved closer to the position of the given articulating member 16 in the open state. For example, one of the articulating members 16 located near the base 22 (at the bottom of FIG. 20) in the closed state has to be moved upwards, or one of the articulating members 16 located farther from the base 22 (at the top of FIG. 20) has to be moved downwards. Because the Bennett mechanism has only a single degree of freedom, the displacement of one of the articulating members 16 will cause the movement of all the other articulating members 16, which results in the stiffening sections 14 being moved farther apart from one another and from the poles 20, and, as a result, the canopy 12 is unrolled from around the poles 20. For opening the shading structure 10, the articulating member 16 has to be moved until the Bennett mechanism is swung over the unstable equilibrium state. If the shading structure 10 comprises a rotation mechanism adapted for applying rotation to the pole 20, then the articulating member 16 has to be moved against the effect of the rotation mechanism of the poles 20 until the unstable equilibrium state is reached. After the unstable equilibrium state is exceeded, the shading structure 10 is forced into the fully open state by the rotation of the poles 20.

Figure 21:
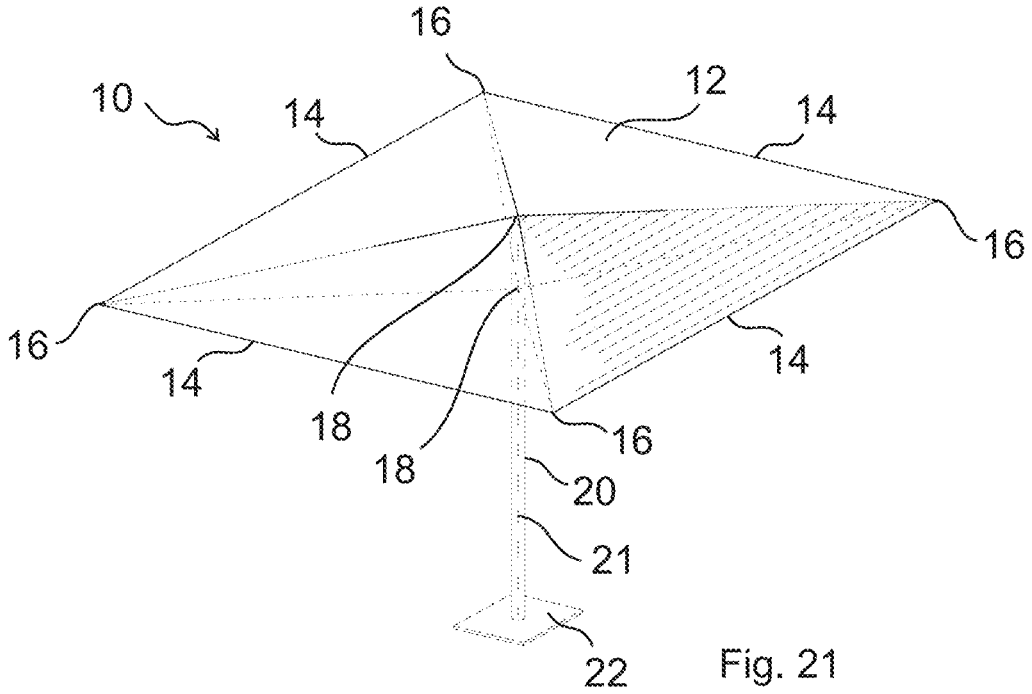
FIG. 21 is a perspective view of another preferred embodiment of the shading structure according to the invention, showing the shading structure in its open state.
Figure 22:
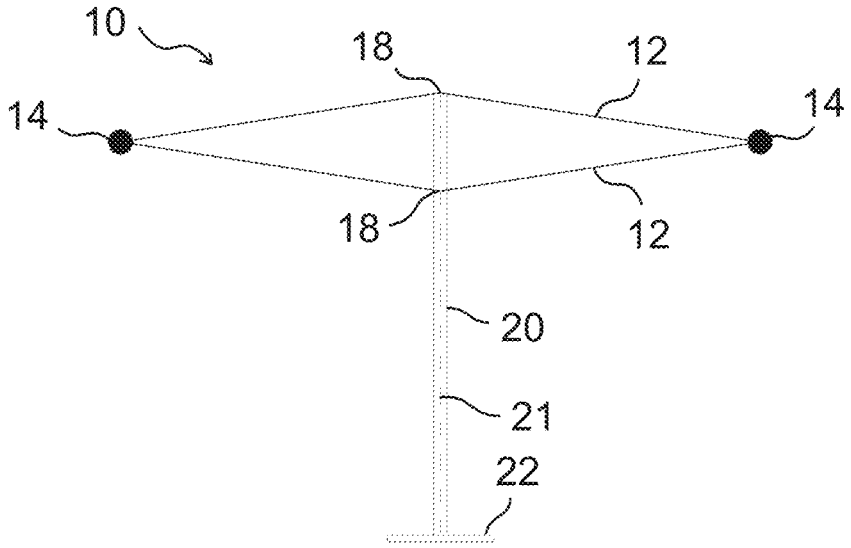
FIG. 22 illustrates a segment of the shading structure according to FIG. 21 in its open state.

In FIGS. 21-22 a further preferred embodiment of the shading structure 10 according to the invention is depicted, wherein the canopy 12 of the shading structure 10 has two layers, and the two layers are adapted for stabilizing the shading structure 10 in the open state. The closing process of the shading structure 10 is not different even with this configuration of the canopy 12, i.e. the structure can be closed (collapsed) by applying rotation about an axis of rotation 21 defined by the attachment places 18 of the canopy 12. The closing process remains the same even if the shading structure 10 comprises a pole 20 with its axis coinciding with the axis of rotation 21; by applying rotation to the pole 20 the shading structure 10 can be brought into the closed state.

The stiffening sections 14 adapted for stiffening and stretching the canopy 12 are arranged along the sides of the square-shaped canopy 12, and are coupled together by articulating members 16 at the corners of the square. The stiffening sections 14 coupled together by the articulating members 16 preferably form a Bennett mechanism that has characteristics identical to the characteristics described in relation to FIGS. 15-20.

FIG. 22 shows a sectional view of the preferred embodiment of the shading structure 10 according to FIG. 21, clearly showing the affixing of both layers of the two-layer canopy 12. Each layer of the canopy 12 has a respective attachment place 18, at which attachment places 18 the canopy 12 is affixed to the pole 20. The principal axis of the pole 20 coincides with the axis of rotation 21 that crosses the attachment places 18. In the preferred embodiment depicted in the figure the shading structure 10 is provided with a base 22. In the open state of the shading structure 10, the stiffening sections 14 adapted for stretching the canopy 12 are supported in a stable manner by affixing the canopy 12 to the attachment places 18 disposed at each layer thereof, without securing the stiffening sections 14 by other means, for example directly to the pole 20.

Figure 23:
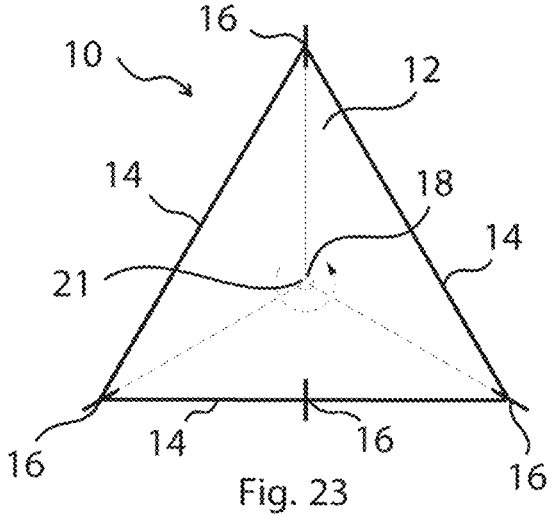
FIG. 23 is a top plan view of a further preferred embodiment of the shading structure according to the invention, showing the shading structure in its open state.

FIG. 23 depicts a further preferred embodiment of the shading structure 10 according to the invention, showing a top plan view of the shading structure 10 in the open state. In this embodiment, the canopy 12 of the shading structure 10 has a triangular shape, preferably an isosceles triangle, or still more preferably an equilateral triangle shape. The canopy 12 comprises a respective stiffening section 14 along each of its three sides, the sections being coupled together at the corners of the triangle and at the midpoint of one of the sides by articulating members 16. The (fourth) articulating member 16 arranged at the midpoint of a side of the triangle allows that the entire canopy 12 can be folded or rolled up around an axis of rotation 21 crossing the attachment place 18 of the canopy 12. The fourth articulating member 16 is preferably arranged at the midpoint of the side constituting the base of the isosceles triangle-shaped canopy 12.

In the case of the preferred embodiment depicted in FIG. 23, the canopy 12 may comprise one or two layers; with a single-layer canopy 12 the attachment places 18 are arranged on the canopy 12 much like in the preferred embodiment according to FIG. 10, and in the case of a shading structure 10 having a two-layer canopy 12 each layer comprises a respective attachment place 18, like in the embodiment according to FIG. 21.

The shading structure 10 according to FIG. 23 consists of four segments, the segments being bounded by straight lines connecting the attachment places 18 and the articulating members 16, wherein the four segments are congruent in pairs.

Figure 24:
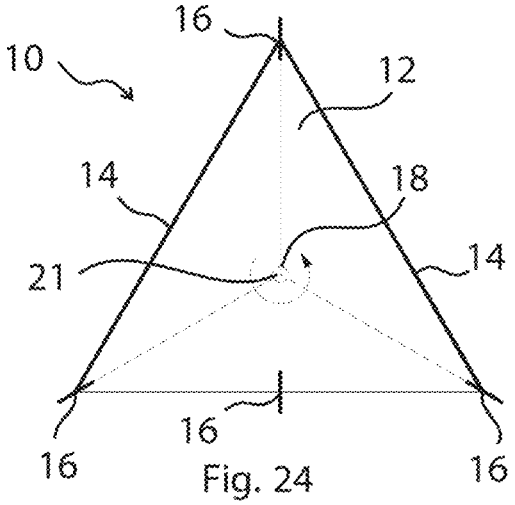
FIG. 24 is a top plan view of a still further preferred embodiment of the shading structure according to the invention, showing the shading structure in its open state.
Figure 25:
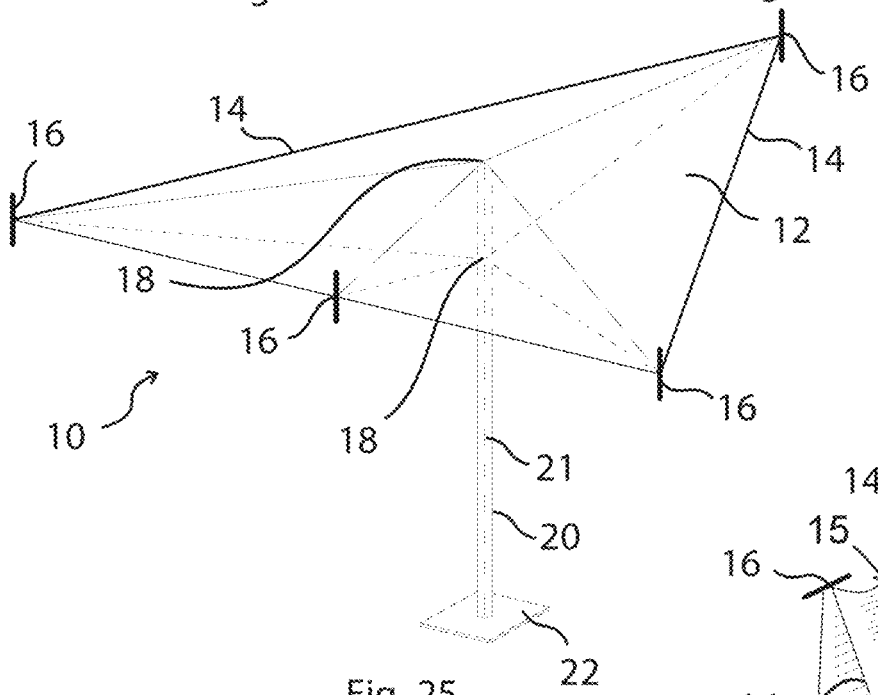
FIG. 25 is a perspective view showing the shading structure according to FIG. 24 in its open state.
Figure 26:
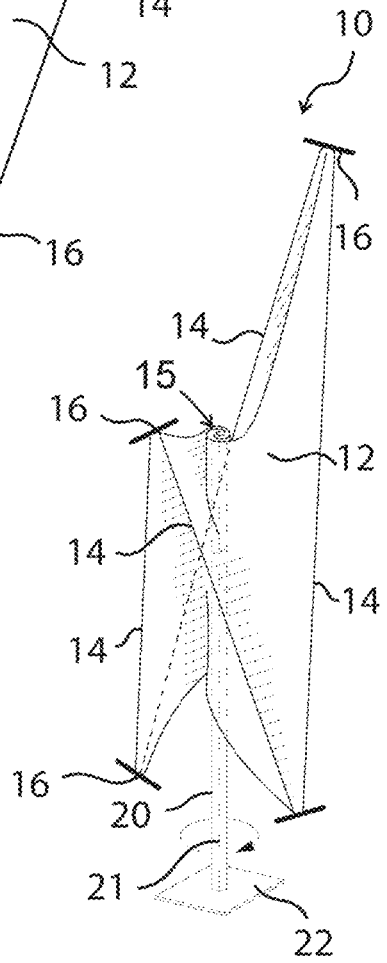
FIG. 26 is a perspective view showing the shading structure according to FIG. 24 in a nearly closed state.

FIGS. 24-26 illustrate a further preferred embodiment of the shading structure 10 according to the invention that, like the embodiment according to FIG. 23, comprises a triangular canopy 12.

FIG. 24 shows a top plan view of a preferred embodiment of the shading structure 10 in the open state. In contrast to the embodiment according to FIG. 23, the embodiment depicted in FIG. 24 comprises stiffening sections 14 (coupled together by means of articulating members 16) only along two sides of the canopy 12, however, the stiffening sections 14 are still capable of stretching out the entire canopy 12 if the articulating member 16 located between the two stiffening sections 14 is continuously forced towards the open state by means of a primary mover 15, for example a spring or another moving mechanism. Stretching of the canopy 12 can also be implemented by applying such articulating members 16 that allow the stiffening sections 14 to move only in directions in which the stiffening sections 14 are drawn further from their positions in the open state of the canopy 12, and so the canopy 12 is kept stretched by the stiffening sections 14 also during the closing process.

In the shading structure 10 according to FIG. 24 there are no articulating members 16 at the non-interconnecting ends of the stiffening sections 14 and at the midpoint of the non-stiffened, third side of the triangular shape, however, by indicating the potential location of the articulating members 16 if, like in FIG. 23, stiffening sections 14 were arranged along all sides, it can be more easily comprehended how, in the closed state of the shading structure 10, the canopy 12 can be rolled up or folded up completely around the axis of rotation 21 defined by the attachment places 18 of the canopy 12.

The canopy 12 can have a single-layer or a dual-layer configuration with characteristics that are identical to the features described above in relation to FIG. 23.

FIG. 25 shows a perspective view of the shading structure 10 that is configured according to FIG. 24 and has a two-layer canopy 12. The shading structure 10 according to FIG. 25 comprises a pole 20 and a base 22 adapted for supporting and holding up the shading structure 10. The axis of the pole 20 preferably coincides with the axis of rotation 21, so, in the closed state of the shading structure 10 the canopy 12 can be rolled up around the pole 20.

FIG. 26 illustrates the shading structure 10 according to FIG. 23 in a state near the closed state. In this embodiment as well, the shading structure 10 can be closed (collapsed)—in case an axis of rotation 21 or a pole 20 is included—by applying rotation about the pole 20, i.e. the canopy 12 is rolled up (folded up) simultaneously with closing (collapsing) the shading structure 10, i.e. the rolling up of the canopy 12 closes the shading structure 10. Similarly, during the opening process of the shading structure 10 the axis of rotation 21 or the pole 20 is rotated.

In the closed state, the embodiment of the shading structure 10 depicted in FIGS. 24-25, comprising only two stiffening sections 14 arranged along the rim of the canopy 12, assumes a shape similar to the shape depicted in FIG. 26. A difference with respect to the previous embodiments is that the non-stiffened side of the canopy 12 can get wrinkled to some extent in the closed state, because then the two stiffening sections 14 are not able to stretch out the third side any more. However, this wrinkle is not larger than the wrinkles of the canopies 12, occurring in the closed state, of conventional umbrellas discussed above.

Figure 27:
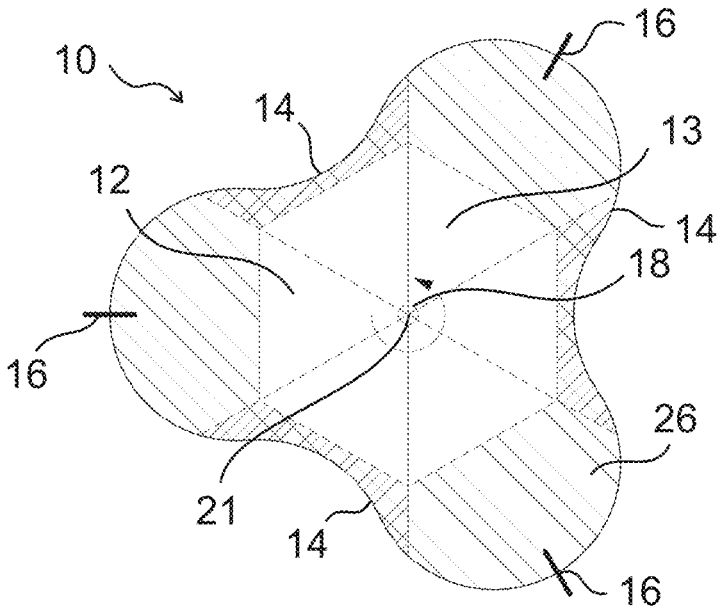
FIG. 27 is a top plan view of a further preferred embodiment of the shading structure according to the invention, showing the shading structure in its open state.
Figure 28:
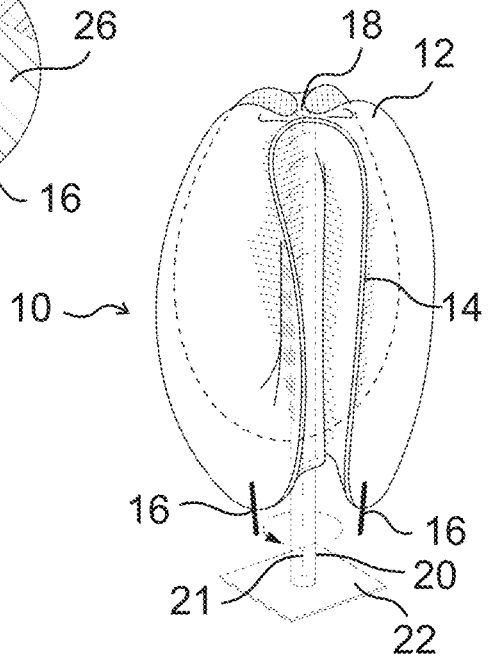
FIG. 28 is a perspective view showing the shading structure according to FIG. 27 in its closed state.
Figure 29:
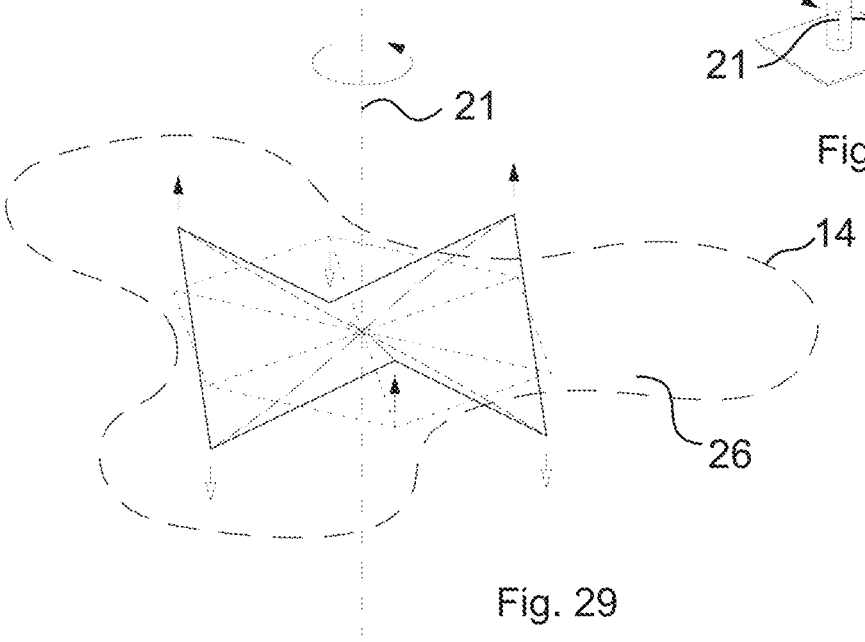
FIG. 29 is a schematic drawing illustrating the closing process of the shading structure according to FIG. 27.

FIGS. 27-29 depict a further preferred embodiment of the shading structure 10 according to the invention, wherein the canopy 12 is formed of six segments shown in FIG. 6. Along the arcuate rim of the canopy 12 arcuate, expediently flexible stiffening sections 14 are arranged that are coupled together by articulating members 16. The canopy 12 can have a single- or dual-layer configuration, and like the above-described preferred embodiments, it comprises attachment places 18 that define an axis of rotation 21. By applying rotation about the axis of rotation 21, the shading structure 10 can be brought from the open state according to FIG. 27 into the closed state according to FIG. 28; and vice versa, rotation in the opposite direction corresponds to bringing the shading structure 10 from the closed state into the open state.

In the preferred embodiment according to FIGS. 27-29, the canopy 12 comprises a roll-up region 13, i.e. a region that can be rolled up, and a non-roll-up region 26, i.e. a region that cannot be rolled up; the non-roll-up region 26 is represented by hatched areas in FIGS. 27. The considerations set forth above in relation to FIGS. 12-13 apply to the roll-up region 13; in the preferred embodiment according to FIG. 27 the roll-up region 13 has a regular hexagonal shape, wherein the stiffening sections 14 are arranged along the rim of the canopy 12 at different distances from the boundary of the roll-up region 13. The stiffening sections 14 are adapted to stretch out the entirety of the canopy 12, but in the closed state of the shading structure 10 only this regular hexagonal-shaped region of the canopy 12 can be gently rolled up around the axis of rotation 21.

In FIG. 28, the shading structure 10 is depicted in the closed state. Expediently, the non-roll-up region 26 of the canopy 12 outwardly encompasses the portion of the canopy 12 rolled up around the axis of rotation 21. In the preferred embodiment according to FIG. 28, the shading structure 10 comprises a pole 20 and a base 22 connected to the pole 20. The pole 20 is preferably allowed to rotate about its own axis that coincides with the axis of rotation 21 of the shading structure 10, and can be rotated relative to the base 22, wherein the shading structure 10 is adapted to be closed (being collapsible) by rotating the pole 20.

FIG. 29 illustrates the movement of the segments in the roll-up region 13 (shown in FIGS. 4-7) during the closing process of the preferred embodiment of the shading structure 10 depicted in FIGS. 27-28. The shading structure 10 can be closed (collapsed) by applying rotation about the axis of rotation 21, during which process the adjacent articulating members 16 are displaced in opposite directions, i.e.

upwards and downwards with respect to the position of said articulating members 16 in the open state of the shading structure 10. The shading structure 10 is brought into the closed state (shown in FIG. 28) as a result of these displacements.

Although the preferred embodiment according to FIGS. 27-29 comprises six segments, it can be set forth as a general rule that in embodiments of the shading structure 10 only an even number of segments can be folded or rolled up around the axis of rotation 21. This is true also in the case wherein, like in the embodiment illustrated in FIG. 27, the shading structure 10 comprises an odd number of (for example, three) articulating members 16. In such cases, the regions of the canopy 12 located near the stiffening sections 14 extending between the articulating members 16 cannot be rolled or folded up. In such cases, the function of the missing articulating members 16 is performed by the stiffening sections 14 that are adapted to bend flexibly.

Figure 30:
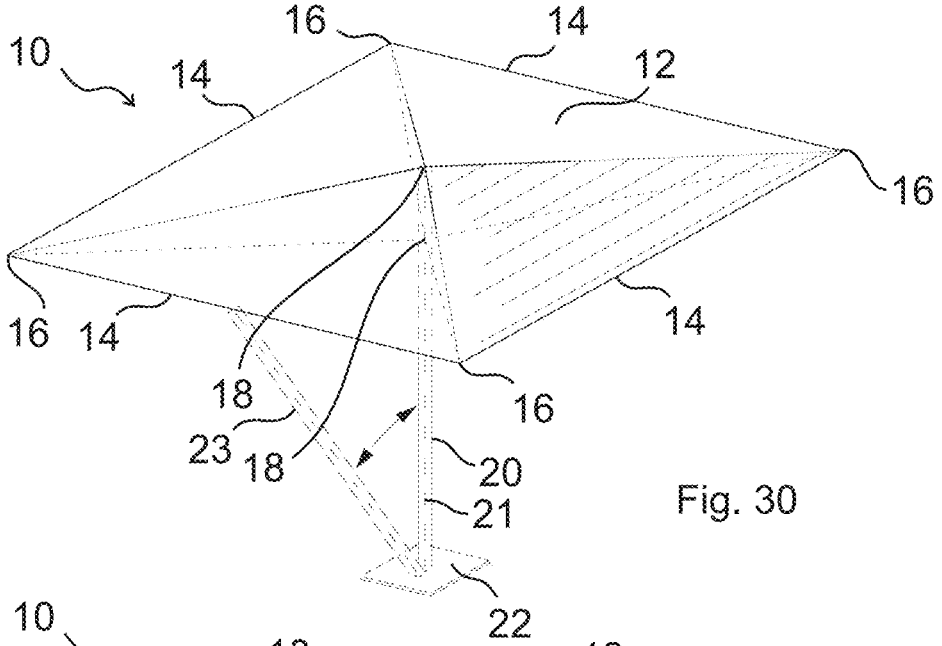
FIG. 30 is a perspective view of another preferred embodiment of the shading structure according to the invention, showing the shading structure in its open state.
Figure 31:
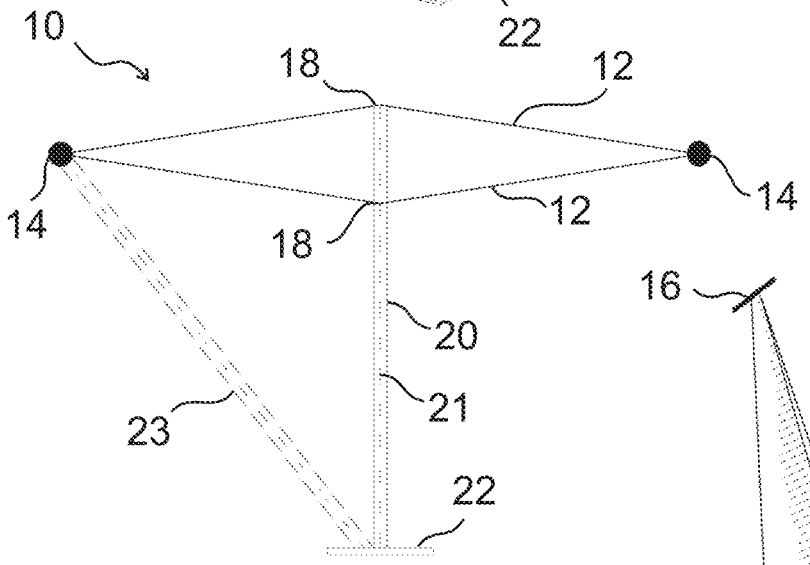
FIG. 31 illustrates a segment of the shading structure according to FIG. 30 in its open state.
Figure 32:
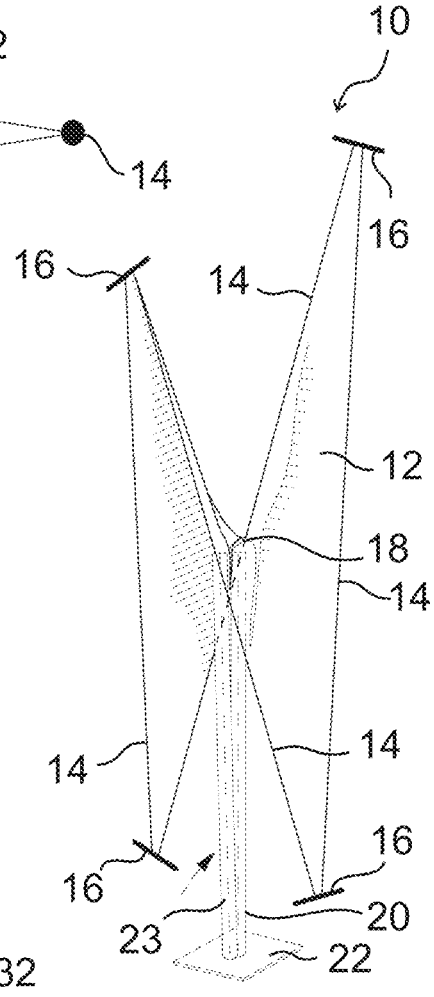
FIG. 32 is a perspective view showing the shading structure according to FIG. 30 in a nearly closed state.

FIGS. 30-32 depict a further preferred embodiment of the shading structure 10 according to the invention, with FIG. 30, FIG. 31, and FIG. 32, respectively, showing the shading structure 10 in a perspective view in the open state, in a sectional view, and in a perspective view in a state near the closed state. The shading structure 10 having this preferred configuration comprises a square-shaped dual-layer canopy 12. The canopy 12 comprises peripherally arranged stiffening sections 14, wherein the stiffening sections 14 are arranged continuously along the circumference of the canopy 12, and wherein the adjacent stiffening sections 14 are coupled together by articulating members 16.

There is a respective attachment place 18 disposed on each layer of the dual-layer canopy 12, the attachment places 18 defining an axis of rotation 21 around which the canopy 12 is rolled up in the closed state of the shading structure 10. In the preferred embodiment according to FIGS. 30-32 the shading structure 10 comprises a pole 20 to which the canopy 12 is affixed at the attachment places 18, wherein the principal axis of the pole 20 coincides with the axis of rotation 21. By applying rotation of the pole 20 about its axis the shading structure 10 can be brought into the closed state, during which process the canopy 12 is rolled up around the pole 20. The shading structure 10 further comprises an auxiliary pole 23, of which one end is attached to the base point of the pole 20 and the other end is attached to one of the stiffening sections 14. The auxiliary pole 23 prevents the canopy 12 from being rotated about the pole 20, thus ensuring the stability of the shading structure 10. The auxiliary pole 23 is configured such that it can be aligned beside the pole 20 but it cannot be rotated about the pole 20. The auxiliary pole 23 is preferably affixed to a point of the stiffening section 14 that is at a constant distance from the base point of the pole 20 during the opening and closing process of the shading structure 10, which allows the auxiliary pole 23 to have a rigid configuration with a non-variable length.

As it was put forward above, the function of the auxiliary pole 23 is to prevent the rotation of the stiffening sections 14 about the axis of rotation 21. This allows that the pole 20 and the auxiliary pole 23 include a moving mechanism, for example a spring or a motor, in, which moving mechanism rotates the pole 20 about the axis of rotation 21, and thereby rolls up the canopy 12 around the pole 20; moving the auxiliary pole 23 further away from the pole 20 results in the shading structure 10 being opened and the canopy 12 being unrolled from around the pole 20. Switching between the open and the closed states of the shading structure 10 can also be performed manually, by rotating the pole 20 and moving the auxiliary pole 23.

In a further preferred embodiment of the shading structure 10 according to the invention the shading structure 10 is configured to comprise an auxiliary pole 23 as shown in FIG. 30, wherein the articulating members 16 are configured such that they urge the stiffening sections 14 coupled thereto to move further apart from each other, thereby moving the canopy 12 of the shading structure 10 towards the open state, which movement is hindered by a releasable retaining mechanism, for example a brake or a ratchet mechanism in the closed state of the shading structure 10. This preferred embodiment of the shading structure 10 can be operated semi-automatically, i.e. after releasing the releasable retaining mechanism the shading structure 10 automatically moves into the open state, while the shading structure 10 can be closed (collapsed) manually, for example by rotating the pole 20.

A preferred embodiment similar to the embodiment according to FIG. 30 is provided by equipping the pole 20 with a primary mover 15, for example a spring or other (passive) moving member, which primary mover 15 urges the shading structure 10 towards the closed position by rotating the pole 20. Further, a releasable retaining mechanism, by way of example a brake or a ratchet mechanism is used by the articulating members 16, the pole 20 or auxiliary pole 23 of the shading structure 10, wherein the mechanism is adapted for preventing the closing of the shading structure 10 in the open state of the shading structure 10. By releasing the releasable retaining mechanism the shading structure 10 is brought into the closed state. To open the shading structure 10, the articulating members 16 have to be opened or the stiffening sections 14 have to be moved further apart from the pole 20.

A further preferred embodiment—similar to the one discussed in relation to FIG. 30—is obtained by configuring the articulating members 16 such that they move the stiffening sections 14 coupled thereto further apart from each other, thereby brining the shading structure 10 into the open state, wherein the pole 20 is configured such that it urges the shading structure 10 towards the closed state, for example by using a passive displacement member coupled to the pole 20. Provided that the magnitude of the forces urging the shading structure 10 towards the open and the closed state are appropriately adjusted, the shading structure 10 has two stable equilibrium states and one unstable equilibrium state. The two stable equilibrium states are the open state and the closed state of the shading structure 10, while the unstable equilibrium state is an intermediate state between the open state and the closed state. For opening and closing the shading structure 10, the shading structure 10 has to be manually swung over the unstable equilibrium state, after which the shading structure 10 assumes the corresponding open state or closed state.

Figure 33:
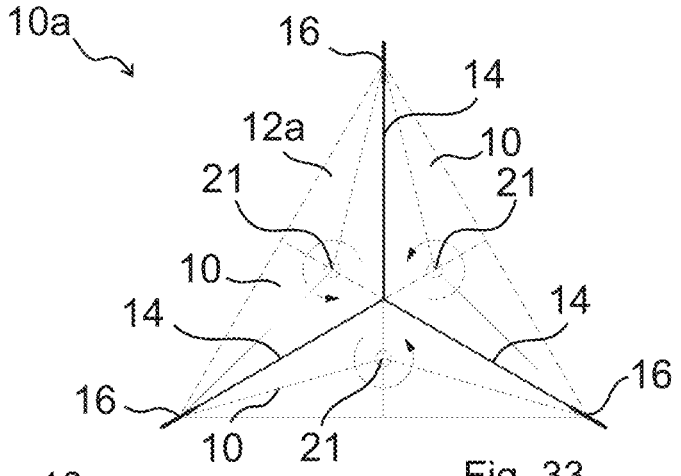
FIG. 33 is a top plan view of a further preferred embodiment of the shading structure according to the invention, showing the shading structure in its open state.

FIG. 33 illustrates a preferred shading structure 10*a* consisting of three shading structures 10, wherein the shading structures 10 comprise a common canopy 12*a*. The shading structure 10*a* preferably comprises three identical shading structures 10 configured similarly to the preferred embodiment according to FIG. 24. Each of the shading structures 10 comprises a canopy 12 having an isosceles triangle shape, wherein stiffening sections 14 are disposed along two sides, preferably along the sides having equal length. In another preferred embodiment, at least one shading structure 10 of the shading structure 10*a* comprises stiffening sections 14 along all sides of the canopy 12. Adjacent stiffening sections 14 are coupled together by articulating members 16 in all preferred embodiments.

Each shading structure 10 has attachment places 18, wherein the shading structure 10 is adapted to be closed (collapsed) by rotation about an axis of rotation 21 crossing said attachment places 18, and wherein the canopy 12 is adapted to be folded or rolled up around the axis of rotation 21.

For closing the shading structure 10*a* in a compact manner, the axes of rotation 21 preferably have a common intersection point, which intersection point is the common base point of the poles 20 oriented in the direction of the axes of rotation 21. The poles 20 are configured at the base point such that they are capable of rotation about their own respective axes as well as of being turned in the direction towards each other. In the closed state of the shading structure 10*a* the poles 20 are aligned beside one another, wherein the canopies 12 of the shading structures 10 are rolled up around the corresponding poles 20.

In a further preferred embodiment, the stiffening sections 14 of the shading structure 10*a* are arranged along an outside rim of the canopy 12*a* in a manner illustrated in FIG. 23 or FIG. 24. The preferred number of the stiffening sections 14 is four (see the configuration according to FIG. 23), or two (see the configuration according to FIG. 24), or six. In this preferred embodiment, in the closed state of the shading structure 10*a* the canopy 12*a* is rolled up part-by-part, i.e. each canopy 12 is rolled up around a respective separate pole 20.

Like with the preferred embodiment according to FIG. 33, further preferred embodiments can be realized by integrating multiple shading structures 10 with canopies 12 having mutually fitting shapes, wherein the adjacent shading structures 10 comprises common stiffening sections 14 arranged along their common sides, or, as with the arrangement according to FIG. 14, they have no common stiffening, and the canopy 12 of each of the shading structures 10 is adapted to be rolled up around a corresponding axis of rotation 21. As it was set forth in relation to the embodiment according to FIG. 33, the axes of rotation 21 may have a common point of intersection, with an even number of segments (see FIGS. 5-6) being arranged, in all cases, about each axis of rotation 21.

Figure 34:
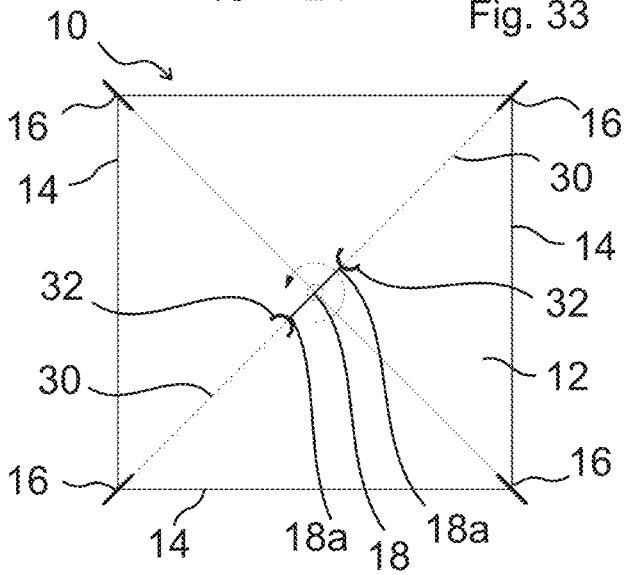
FIG. 34 is a top plan view of a further preferred embodiment of the shading structure according to the invention, showing the shading structure in its open state.
Figure 35:
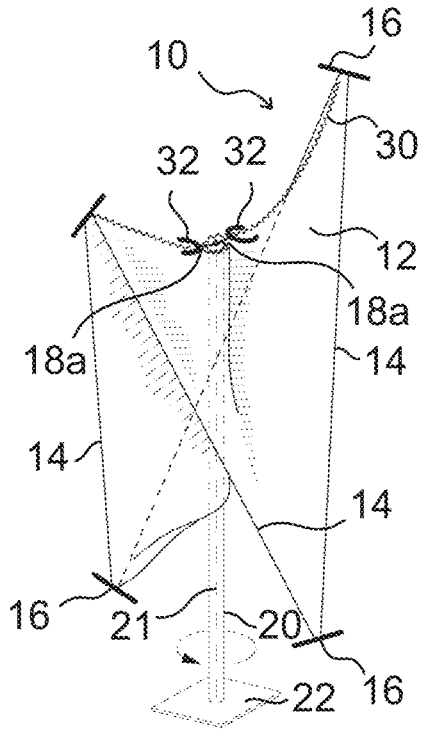
FIG. 35 is a perspective view showing the shading structure according to FIG. 34 during the closing process.

In FIGS. 34-35 a further preferred embodiment of the shading structure 10 according to the invention is illustrated, FIG. 34 showing a top plan view of the shading structure 10 in the open state, and FIG. 35 showing a perspective view thereof in a state near the closed state. As with the embodiments described above, the shading structure 10 according to the preferred embodiments depicted in FIGS. 34-35 comprise a canopy 12 adapted to be stretched out by stiffening sections 14 in the open state, wherein the stiffening sections 14, that are coupled together by articulating members 16, are arranged peripherally along the rim of the canopy 12.

The shading structure 10 according to FIGS. 34-35 comprises a pole 20 to which the canopy 12 is affixed at an attachment place 18, wherein the canopy 12 is rolled up, in the closed state of the shading structure 10, around an axis of rotation 21 crossing the attachment place 18 of the canopy. The pole 20 extends in the same direction as the axis of rotation 21, so in the closed state of the shading structure 10 the canopy 12 is rolled up around the pole 20.

In the preferred embodiment of the shading structure 10 according to FIGS. 34-35, a path 30 extending between the attachment place 18 and the rim of the canopy 12 is formed in the canopy 12, wherein a guide member 32 is arranged on the path 30.

The guide member 32 is adapted for pulling the canopy 12 towards the attachment place 18 along the path 30 when the shading structure 10 is being closed, and for unrolling the canopy 12 from around the axis of rotation 21 along the path 30 when the shading structure 10 is being opened.

In this preferred embodiment, the guide member 32 arranged on the path 30 defines a further attachment point 18*a* of the canopy 12. The guide member 32 is arranged on a path 30 formed in the canopy 12 in a position spaced apart from the attachment place 18, and is secured to the path 30. During the opening and closing process of the shading structure 10 the material of the canopy 12 is guided along the path 30 by the guide member 32, thereby securing the canopy 12 as it is being unrolled from around the pole 20 and rolled up around the pole 20.

During the closing process of the shading structure 10 the adjacent articulating members 16 are moved alternatively upwards and downwards, while the angle between the stiffening sections 14 connected to the articulating member 16 is reduced, the canopy 12, guided by the guide members 32 along the paths 30, is rolled up around or folded up on the pole 20, and the stiffening sections 14 become aligned beside the pole 20. The stiffening sections 14 and the articulating members 16 are not rotated about the pole 20 during the closing process of the shading structure 10 due to the fixed-position arrangement of the guide members 32.

An opposite-direction process is carried out when the shading structure 10 is opened, i.e. the canopy 12 is unrolled from around the pole 20 rotating in a direction opposite to the roll-up direction, while the canopy 12 is kept guided along the path 30 by the guide member 32. During the opening process the material of the canopy 12 is continuously stretched out by the opening articulating members 16, gradually increasing the angle between the adjacent stiffening sections 14.

The preferred embodiment according to FIGS. 34-35 comprises two paths 30, each having a corresponding guide member 32. In case a multiple-layer canopy 12 is applied, each layer of the canopy 12 may preferably have a corresponding path 30 and a guide member 32.

Figure 36:
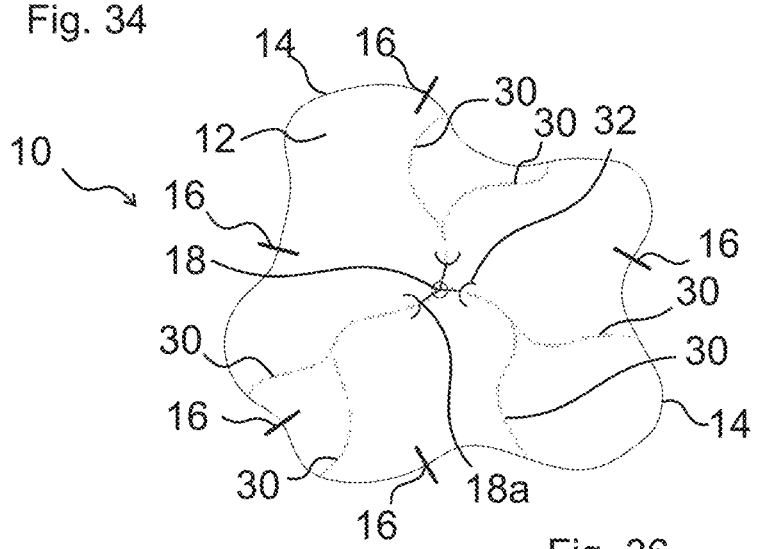
FIG. 36 is a top plan view of a further preferred embodiment of the shading structure according to the invention, showing the shading structure in its open state.

FIG. 36 depicts a further preferred embodiment of the shading structure 10 according to the invention that also comprises a path 30, showing a top plan view of a shading structure 10 in the open state. The canopy 12 of the shading structure 10 can have an arbitrary shape; the canopy 12 is stretched out in the open state of the shading structure 10 by stiffening sections 14, expediently stiffening sections 14 having an arcuate shape corresponding to the shape of the rim of the canopy 12, arranged peripherally along the rim of the canopy 12. The stiffening sections 14 are coupled together by articulating members 16 along the rim of the canopy 12.

Like with the preferred embodiments according to FIG. 34-35, the paths 30 included in the preferred embodiment according to FIG. 36 are adapted for preventing the stiffening sections 14 from being rotated about the axis of rotation 21, and thereby stabilize the shading structure 10. The preferred embodiment according to FIG. 36 comprises paths 30 that are branching, wherein the guide member 32 is arranged on the path 30 drawing the branched-off portions of the path 30 nearer to each other during the closing process of the shading structure 10. As a result of that, the folding up or roll-up of the canopy 12 will not be uniform, i.e. the material of the canopy 12 may get wrinkled. However, such wrinkles are not any more significant than the wrinkles of the canopies 12, occurring in the closed state, of conventional umbrellas discussed above.

The manner of industrial application of the invention follows from the characteristics of the technical solution described above. As can be seen from the above, the 5 invention fulfils its objectives in a very preferable manner compared to the prior art.

The invention is, of course, not limited to the preferred embodiments described in details above, but further variants, modifications and developments are possible within the scope of protection determined by the claims, for example by combining the preferred embodiments illustrated also in the figures.

LEGENDS

10 shading structure
10*a* shading structure
12 canopy
12*a* canopy
13 (roll-up) region
14 stiffening section
16 articulating member
18 attachment place
18*a* attachment place
20 pole
21 axis of rotation
22 base
23 auxiliary pole
24 boundary line
26 (non-roll-up) region
30 path
32 guide member

The invention claimed is:

1. A shading structure (10) having an open state and a closed state and comprising a canopy (12) comprising at least two attachment places (18), wherein the canopy (12) is affixed to further components of the shading structure (10) at the at least two attachment places (18), wherein the two attachment places (18) are inside places of the canopy (12) and define an axis of rotation (21), and at least two stiffening sections (14) arranged along a periphery of the canopy (12), wherein adjacent stiffening sections (14) are coupled to each other by a respective articulating member (16), and wherein the canopy (12) is stretched in the open state of the shading structure (10) by means of the stiffening sections (14) coupled to each other by the articulating member(s) (16), wherein the at least two attachment places (18) are inside of the canopy (12). in the open state of the shading structure (10) the stiffening sections (14) are skew with respect to the axis of rotation (21), and in the closed state of the shading structure (10) the stiffening sections (14) extend in the direction of the axis of rotation (21), and the canopy (12) is rolled up around the axis of rotation (21) wherein the shading structure (10) comprises a pole (20) extending in the direction of the axis of rotation (21), to which the canopy (12) is directly affixed at the attachment places (18) and around which the canopy (12) is rolled up in the closed state of the shading structure (10).

2. A shading structure (10) having an open state and a closed state and comprising:

a canopy (12) comprising at least two attachment places (18), wherein the canopy (12) is affixed to further components of the shading structure (10) at the at least two attachment places (18), wherein the two attachment places (18) are inside places of the canopy (12) and define an axis of rotation (21);

a pole (20) extending in the direction of the axis of rotation (21), to which the canopy (12) is affixed at the attachment places (18) and around which the canopy (12) is rolled up in the closed state of the shading structure (10);

at least two stiffening sections (14) arranged along a periphery of the canopy (12), wherein adjacent stiffening sections (14) are coupled to each other by a respective articulating member (16), and wherein the canopy (12) is stretched in the open state of the shading structure (10) by means of the stiffening sections (14) coupled to each other by the articulating member(s) (16); and an auxiliary pole (23), the endpoints of which are connected to a base point of the pole (20) and to one of the at least two stiffening sections (14), respectively, and a connection point of which is a point of the stiffening section (14) that is located at the same distance from the base point of the pole (20) in both the open and closed states of the shading structure (10), wherein the at least two attachment places (18) are inside of the canopy (12), in the open state of the shading structure (10) the stiffening sections (14) are skew with respect to the axis of rotation (21), and in the closed state of the shading structure (10) the stiffening sections (14) extend in the direction of the axis of rotation (21), and the canopy (12) is rolled up around the axis of rotation (21).

3. The shading structure (10) according to claim 2, characterised in that the articulating members (16) are equipped with primary movers adapted for allowing bidirectional movement and for urging the shading structure (10) to open.

4. The shading structure (10) according to claim 2, characterised in that a primary mover is connected to the pole (20), the primary mover being adapted for allowing bidirectional rotation and for urging the shading structure (10) to close.

5. The shading structure (10) according to claim 2, characterised in that the shading structure (10) comprises a base (22) or a handle connected to the base point of the pole (20).

* * * * *